US012376720B2

(12) United States Patent
Der Marderosian et al.

(10) Patent No.: US 12,376,720 B2
(45) Date of Patent: Aug. 5, 2025

(54) AGITATOR WITH DEBRIDER AND HAIR REMOVAL

(71) Applicant: SHARKNINJA OPERATING LLC, Needham, MA (US)

(72) Inventors: Daniel R. Der Marderosian, Westwood, MA (US); John Freese, Chestnut Hill, MA (US); Gordon Howes, Suzhou (CN); Wenxiu Gao, Suzhou (CN); David S. Clare, London (GB); Nathan Herrmann, Middlebury, VT (US); Hugh Jamie Croggon, London (GB); Nicholas Sardar, London (GB); Tyler Smith, Boston, MA (US); Ian Liu, Suzhou (CN); Jiancheng Wang, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 2 days.

(21) Appl. No.: 18/435,600

(22) Filed: Feb. 7, 2024

(65) Prior Publication Data

US 2024/0215778 A1 Jul. 4, 2024

Related U.S. Application Data

(63) Continuation of application No. 17/182,090, filed on Feb. 22, 2021, now Pat. No. 11,925,303, which is a (Continued)

(51) Int. Cl.
*A47L 9/04* (2006.01)
*A46B 13/00* (2006.01)
(Continued)

(52) U.S. Cl.
CPC ..... *A47L 9/0477* (2013.01); *A46B 13/001* (2013.01); *A47L 11/24* (2013.01); (Continued)

(58) Field of Classification Search
CPC ..... A47L 9/0477; A47L 11/4041
See application file for complete search history.

(56) References Cited

U.S. PATENT DOCUMENTS 1,642,518 A 9/1927 Throop
1,706,039 A 3/1929 Owen
(Continued)

FOREIGN PATENT DOCUMENTS

CA 2178202 A1 4/1996
CA 2273103 A1 10/1999
(Continued)

OTHER PUBLICATIONS

US 8,359,703 B2, 01/2013, Svendsen et al. (withdrawn)
(Continued)

*Primary Examiner* — Bryan R Muller
(74) *Attorney, Agent, or Firm* — Grossman Tucker Perreault & Pfleger, PLLC

(57) ABSTRACT

A surface cleaning apparatus including a body defining an agitation chamber, an agitator partially disposed within the agitation chamber and configured to rotate about a pivot axis, and a debrider at least partially disposed within the agitation chamber. The agitator includes an elongated body having a first and a second end, a sidewall extending radially outward from the elongated body extending between the first and the second ends, and a plurality of bristles extending radially outward from the elongated body. The plurality of bristles are arranged in at least one row adjacent to the (Continued)

sidewall. The debrider includes a plurality of teeth configured to contact a portion of the sidewall as the agitator rotates about the pivot axis.

35 Claims, 22 Drawing Sheets

Related U.S. Application Data continuation of application No. 15/917,598, filed on Mar. 10, 2018, now Pat. No. 10,925,447.

(60) Provisional application No. 62/469,853, filed on Mar. 10, 2017.

(51) Int. Cl.
*A47L 11/24* (2006.01)
*A47L 11/40* (2006.01)
*A46B 17/06* (2006.01)

(52) U.S. Cl.
CPC ..... *A47L 11/4041* (2013.01); *A47L 11/4094* (2013.01); *A46B 17/06* (2013.01); *A47L 2201/00* (2013.01)

(56) References Cited

U.S. PATENT DOCUMENTS 2,089,600 A 8/1937 Edwards
2,241,775 A 5/1941 Forsberg
2,587,038 A 2/1952 Goodell
2,707,792 A 5/1955 Waller
2,734,212 A 2/1956 Koch
2,785,431 A 3/1957 Pardee
2,869,170 A 1/1959 Wessel
2,960,714 A 11/1960 Senne
3,612,052 A 10/1971 Krummenacher
3,643,282 A 2/1972 Lechene
3,737,937 A 6/1973 Nordeed
3,828,430 A 8/1974 Yamada et al.
4,177,536 A 12/1979 Powers
4,307,479 A 12/1981 Mertes et al.
4,372,004 A 2/1983 Vermillion
4,384,386 A 5/1983 Dorner et al.
4,403,372 A 9/1983 Keane et al.
4,955,107 A 9/1990 Kawai
5,014,387 A 5/1991 Hays
5,109,976 A 5/1992 Mohri et al.
5,272,785 A 12/1993 Stegens
5,373,603 A 12/1994 Stegens
5,435,038 A 7/1995 Sauers
5,452,490 A 9/1995 Brundula et al.
5,465,451 A 11/1995 Stegens
5,482,562 A 1/1996 Abernathy
5,495,634 A 3/1996 Brundula et al.
5,611,109 A 3/1997 Worwag
5,890,250 A 4/1999 Lange et al.
6,058,582 A 5/2000 Gardner et al.
6,161,245 A 12/2000 Weihrauch
6,170,119 B1 1/2001 Conrad et al.
6,226,832 B1 5/2001 McCormick
6,237,188 B1 5/2001 Takemoto et al.
6,314,611 B1 11/2001 Sauers
6,324,714 B1 12/2001 Walz et al.
6,367,781 B1 4/2002 Flynn et al.
6,539,575 B1 4/2003 Cohen
6,591,441 B2 7/2003 Stegens et al.
6,810,559 B2 11/2004 Mertes et al.
6,883,201 B2 4/2005 Jones et al.
6,892,416 B2 * 5/2005 Lee ..... A46B 5/06 15/59
6,892,420 B1 5/2005 Haan et al.
6,971,140 B2 12/2005 Kim
D518,258 S 3/2006 Hamm et al.
7,007,336 B2 3/2006 Roney et al.
7,079,923 B2 7/2006 Abramson et al.
7,140,062 B1 11/2006 Chen
7,185,396 B2 3/2007 Im et al.
7,448,113 B2 11/2008 Jones et al.
7,571,511 B2 8/2009 Jones et al.
7,636,982 B2 12/2009 Jones et al.
7,690,079 B2 4/2010 Boddy et al.
7,979,952 B2 7/2011 Beskow et al.
8,032,985 B2 10/2011 Seo
8,060,967 B1 11/2011 Johnson, Jr.
8,083,167 B1 12/2011 Namakian et al.
8,087,117 B2 1/2012 Kapoor et al.
8,117,714 B2 2/2012 Nguyen et al.
8,250,704 B2 8/2012 Yoo
D680,289 S * 4/2013 Gray ..... D32/31
8,418,303 B2 4/2013 Kapoor et al.
8,438,695 B2 5/2013 Gilbert, Jr. et al.
8,443,477 B2 5/2013 Jang et al.
8,474,090 B2 7/2013 Jones et al.
8,505,158 B2 8/2013 Han et al.
8,572,799 B2 11/2013 Won et al.
8,601,643 B2 12/2013 Eriksson
8,646,984 B2 2/2014 Gagnon
8,656,550 B2 2/2014 Jones et al.
8,661,605 B2 3/2014 Svendsen et al.
8,671,507 B2 3/2014 Jones et al.
8,671,515 B2 3/2014 Eriksson
8,695,144 B2 4/2014 Jang et al.
8,720,001 B2 5/2014 Courtney et al.
8,741,013 B2 6/2014 Swett et al.
8,763,199 B2 7/2014 Jones et al.
8,800,107 B2 8/2014 Blouin
8,826,493 B2 9/2014 Stegens
8,832,902 B2 9/2014 Kim et al.
8,881,399 B2 11/2014 Gilbert, Jr. et al.
8,910,342 B2 12/2014 Gilbert, Jr. et al.
8,955,192 B2 2/2015 Gilbert, Jr. et al.
9,010,882 B2 4/2015 Romanov et al.
9,038,233 B2 5/2015 Jones et al.
9,066,640 B2 6/2015 Iles et al.
9,072,416 B2 7/2015 Kowalski
9,144,356 B2 9/2015 Yun
9,167,946 B2 10/2015 Jones et al.
9,192,273 B2 11/2015 Eriksson
9,295,362 B2 3/2016 Eriksson
9,295,364 B2 3/2016 Eriksson
9,314,140 B2 4/2016 Eriksson
9,320,398 B2 4/2016 Hussey et al.
9,320,399 B2 4/2016 Ventress et al.
9,320,400 B2 4/2016 Gilbert, Jr. et al.
9,326,654 B2 5/2016 Doughty
9,375,122 B2 6/2016 Eriksson
9,392,921 B2 7/2016 Baek et al.
9,480,374 B2 11/2016 Li et al.
9,492,048 B2 11/2016 Won et al.
9,615,708 B2 4/2017 Kowalski
9,648,999 B2 5/2017 Uphoff et al.
9,756,998 B2 9/2017 Kasper et al.
9,775,477 B2 10/2017 Eriksson
9,820,624 B2 11/2017 Eriksson
9,820,626 B2 11/2017 Eriksson et al.
9,833,115 B2 12/2017 Eriksson
9,839,335 B2 12/2017 Eriksson
9,848,746 B2 12/2017 Feng
9,949,605 B2 4/2018 Isley et al.
10,045,672 B2 8/2018 Eriksson
10,314,449 B2 6/2019 Blouin
11,109,735 B2 9/2021 Gunter et al.
11,395,569 B2 7/2022 Kasper et al.
11,647,881 B2 5/2023 Thorne et al.
2002/0124334 A1 9/2002 Worwag
2003/0145424 A1 8/2003 Stephens et al.
2003/0204923 A1 11/2003 Nakamura
2005/0236733 A1 10/2005 Chida et al.
2006/0037170 A1 2/2006 Shimizu
2006/0042042 A1 3/2006 Mertes et al.
2006/0053584 A1 3/2006 Dever
2006/0293794 A1 12/2006 Harwig et al.

(56) References Cited

U.S. PATENT DOCUMENTS

2007/0209147 A1 9/2007 Krebs et al.
2007/0261193 A1 11/2007 Gordon et al.
2008/0052846 A1* 3/2008 Kapoor ..... A47L 9/19 15/52.1
2008/0115736 A1 5/2008 Porter et al.
2009/0000057 A1 1/2009 Yoo et al.
2009/0205153 A1 8/2009 Morphey
2009/0229075 A1 9/2009 Eriksson
2010/0011529 A1 1/2010 Won et al.
2010/0107357 A1 5/2010 Odachi et al.
2010/0205768 A1 8/2010 Oh
2010/0313912 A1 12/2010 Han et al.
2012/0084938 A1 4/2012 Fu
2012/0169497 A1 7/2012 Schnittman et al.
2013/0007982 A1 1/2013 Yun
2013/0042429 A1 2/2013 Misumi et al.
2013/0058635 A1 3/2013 Vrdoljak
2013/0152337 A1 6/2013 Thorne
2013/0198995 A1 8/2013 Eriksson
2013/0205520 A1 8/2013 Kapoor et al.
2014/0053351 A1 2/2014 Kapoor et al.
2014/0143978 A1 5/2014 Li et al.
2014/0150201 A1 6/2014 McGee et al.
2014/0173849 A1 6/2014 Ando et al.
2014/0196236 A1* 7/2014 Ventress ..... A47L 9/0477 15/182
2014/0259521 A1 9/2014 Kowalski
2014/0259522 A1 9/2014 Kasper et al.
2014/0317879 A1 10/2014 Blouin
2014/0359968 A1 12/2014 Eriksson et al.
2014/0366300 A1 12/2014 Eriksson
2015/0013102 A1 1/2015 Bilger
2015/0040340 A1 2/2015 Bilger et al.
2015/0135474 A1 5/2015 Gidwell
2015/0230676 A1 8/2015 Eriksson
2015/0297054 A1 10/2015 Weeks et al.
2015/0313431 A1 11/2015 Eriksson
2015/0342430 A1 12/2015 Kasper et al.
2015/0351596 A1 12/2015 Thorne
2015/0359396 A1 12/2015 Yun
2016/0058257 A1 3/2016 Ventress et al.
2016/0113469 A1 4/2016 Schnittman et al.
2016/0128530 A1 5/2016 Thorne et al.
2016/0166052 A1 6/2016 Kasper et al.
2016/0166127 A1 6/2016 Lewis
2016/0174793 A1 6/2016 Burke et al.
2016/0213217 A1 7/2016 Doughty
2016/0220080 A1 8/2016 Thorne
2016/0220081 A1 8/2016 Xu et al.
2016/0220082 A1 8/2016 Thorne et al.
2016/0220084 A1 8/2016 Xu et al.
2016/0324388 A1 11/2016 Vrdoljak et al.
2016/0345792 A1 12/2016 Herron et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0172363 A1 6/2017 Eriksson et al.
2017/0172364 A1 6/2017 Eriksson
2017/0209008 A1 7/2017 Isley et al.
2017/0215667 A1 8/2017 Thorne et al.
2017/0280957 A1 10/2017 Jeong et al.
2017/0311767 A1 11/2017 Fang
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0184862 A1 7/2018 Choi et al.
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0307302 A1 10/2019 Zheng et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046183 A1 2/2020 Choi et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0297172 A1 9/2020 Tonderys et al.
2021/0169289 A1 6/2021 Thorne et al.
2021/0254615 A1 8/2021 Vrdoljak et al.
2021/0307581 A1 10/2021 Thorne et al.
2022/0071459 A1 3/2022 Gacin et al.

FOREIGN PATENT DOCUMENTS

CA 2273103 C 1/2005
CA 2744592 1/2012
CN 1887171 1/2007
CN 101076277 11/2007
CN 201469183 U 5/2010
CN 201573207 U 9/2010
CN 201573208 U 9/2010
CN 201595776 10/2010
CN 201602713 U 10/2010
CN 201755197 U 3/2011
CN 101375781 B 11/2011
CN 202141815 U 2/2012
CN 102481080 5/2012
CN 102727136 10/2012
CN 102039595 B 2/2013
CN 102218740 B 3/2014
CN 103829882 6/2014
CN 203914774 11/2014
CN 204016183 U 12/2014
CN 204074580 U 1/2015
CN 104605789 5/2015
CN 104750105 A 7/2015
CN 204427936 7/2015
CN 104977926 A 10/2015
CN 102866433 B 11/2015
CN 105982615 A 10/2016
CN 205620809 U 10/2016
CN 205671990 U 11/2016
CN 104216404 B 2/2017
CN 104248397 B 6/2017
CN 206403708 U 8/2017
CN 107233047 A 10/2017
CN 206860741 U 1/2018

(56) References Cited

FOREIGN PATENT DOCUMENTS

| | | | |
|---|---|---|---|
| CN | 104224054 | B | 3/2018 |
| CN | 107788913 | A | 3/2018 |
| DE | 102007006654 | A1 | 8/2008 |
| DE | 102010017211 | A1 | 12/2011 |
| DE | 102010017258 | A1 | 12/2011 |
| DE | 102012207357 | A1 | 11/2013 |
| DE | 102015106094 | | 11/2016 |
| DE | 102019106501 | A1 | 9/2020 |
| EP | 1827192 | | 9/2007 |
| EP | 1994869 | A2 | 11/2008 |
| EP | 2543301 | | 1/2013 |
| EP | 2543301 | A1 | 1/2013 |
| EP | 2570067 | | 3/2013 |
| EP | 2941994 | | 11/2015 |
| EP | 3073881 | | 10/2016 |
| GB | 338414 | A | 11/1930 |
| GB | 583738 | | 12/1946 |
| GB | 1109783 | A | 4/1968 |
| GB | 2310213 | A | 8/1997 |
| GB | 2529819 | A | 3/2016 |
| GB | 2546540 | | 7/2017 |
| JP | S62155812 | A | 7/1987 |
| JP | H0670868 | | 3/1994 |
| JP | 07039488 | | 2/1995 |
| JP | H08131374 | | 5/1996 |
| JP | 2000139786 | | 5/2000 |
| JP | 2000166826 | A | 6/2000 |
| JP | 2004222912 | A | 8/2004 |
| JP | 2008043351 | | 2/2008 |
| JP | 2008161260 | | 7/2008 |
| JP | 2009045503 | A | 3/2009 |
| JP | 2010063624 | A | 3/2010 |
| JP | 2010246848 | | 11/2010 |
| JP | 2011050428 | A | 3/2011 |
| JP | 2011188951 | | 9/2011 |
| JP | 2014087385 | A | 5/2014 |
| KR | 1020130107152 | A | 7/1987 |
| KR | 1020170111688 | A | 10/2017 |
| WO | 1992010967 | A1 | 7/1992 |
| WO | 0076385 | | 12/2000 |
| WO | 2005111084 | A2 | 11/2005 |
| WO | 2009117383 | A2 | 9/2009 |
| WO | 2014095604 | A1 | 6/2014 |
| WO | 2014140872 | A2 | 9/2014 |
| WO | 2014177216 | A1 | 11/2014 |
| WO | 2016030756 | A1 | 3/2016 |
| WO | 2016034848 | A1 | 3/2016 |

OTHER PUBLICATIONS

Chinese Office Action with machine-generated English translation issued Sep. 22, 2023, received in Chinese Patent Application No. 201780055478.6, 41 pages.
Chinese Office Action with machine-generated English translation issued Sep. 14, 2023, received in Chinese Patent Application No. 202111652130.X, 9 pages.
Australian Office Action issued Dec. 20, 2022, received in Australian Patent Application No. 2021202946, 4 pages.
European Examination Report issued Jan. 17, 2023, received in European Patent Application No. 18897246.7, 4 pages.
Chinese Office Action with machine-generated translation issued May 27, 2023, received in Chinese Application No. 202111652130.X, 10 pages.
EP Search Report issued Dec. 1, 2020, received in EP Application No. 18763596.6, 7 pgs.
EP Search Report issued Nov. 26, 2020, received in EP Application No. 18806571.8, 7 pgs.
EP Search Report issued Nov. 26, 2020, received in EP Application No. 18894320.3, 6 pgs.
EP Search Report issued Nov. 25, 2020, received in EP Application No. 18897246.7, 7 pgs.
Canadian Examiners Report issued Nov. 6, 2020, received in Canadian Application No. 3,036,354, 4 pgs.
Chinese Office Action with translation issued Sep. 1, 2020, received in Chinese Application No. 201880023329.6, 12 pgs.
Chinese Office Action with translation issued Sep. 1, 2020, received in Chinese Application No. 201780055478.6, 10 pgs.
US Office Action mailed Jun. 17, 2020, received in U.S. Appl. No. 15/699,358, 16 pgs.
Chinese Office Action with English translation issued May 22, 2020, received in Chinese Patent Application No. 201880043227.0, 8 pgs.
Canadian Office Action issued Mar. 4, 2020, received in Canadian Patent Application No. 3,036,354, 4 pgs.
PCT Search Report and Written Opinion mailed May 3, 2019, received in corresponding PCT Application No. PCT/US18/67163, 14 pgs.
US Office Action mailed May 1, 2019, received in U.S. Appl. No. 15/699,358, 26 pgs.
PCT Search Report and Written Opinion mailed Mar. 5, 2019, received in related PCT Application No. PCT/US18/67171, 8 pgs.
PCT Search Report and Written Opinion mailed Aug. 24, 2018, received in related PCT Application No. PCT/US18/34668, 7 pgs.
PCT International Search Report and Written Opinion mailed Jun. 6, 2018, received in corresponding PCT Application No. PCT/US18/2188, 12 pgs.
PCT Search Report and Written Opinion mailed Dec. 20, 2017, received in corresponding PCT Application No. PCT/US17/50691, 11 pgs.
U.S. Office Action dated Mar. 14, 2024, received in U.S. Appl. No. 17/587,569, 26 pages.
U.S. Office Action dated Feb. 20, 2024, received in U.S. Appl. No. 18/393,800, 27 pages.
Bissell Cleanview Swivel Pet Brushroll Vendor Data (Year: 2016), 4 pages. (https://www.ezvacuum.com/bissell-triple-action-brush-roll-13-5-160-4545.html).
U.S. Office Action dated Jul. 2, 2024, received in U.S. Appl. No. 17/587,569, 25 pages.
US Office Action mailed Sep. 26, 2019, received in U.S. Appl. No. 16/229,796, 12 pgs.
US Office Action mailed Feb. 19, 2021, received in U.S. Appl. No. 15/699,358, 17 pages.
Chinese Office Action with translation issued May 24, 2021, received in China Application No. 201780055478.6, 8 pgs.
Chinese Office Action with English translation issued Jun. 3, 2021, received in Chinese Patent Application No. 201880090257.7, 16 pages.
UK Examination Report dated Jul. 8, 2021, received in U.K. Patent Application No. GB1903295.2, 2 pages.
Canadian Office Action issued Aug. 13, 2021, received in Canadian Patent Application No. 3,036,354, 3 pages.
Chinese Office Action with English translation issued Aug. 18, 2021, received in Chinese Patent Application No. 201880090292.9, 11 pages.
Chinese Decision of Rejection with English translation issued Sep. 3, 2021, received in Chinese Patent Application No. 201780055478.6, 7 pages.
Chinese Office Action with English translation issued Apr. 27, 2021, received in Chinese Patent Application No. 201880023329.6, 13 pages.
UK Examination Report issued Nov. 16, 2021, received in UK Patent Application No. GB1903295.2, 2 pages.
US Office Action mailed Feb. 16, 2022, received in U.S. Appl. No. 16/229,363, 10 pages.
Chinese Office Action with English translation issued Mar. 2, 2022, received in Chinese Patent Application No. 202110308172.5, 11 pages.
Chinese Office Action with English translation issued Apr. 1, 2022, received in Chinese Patent Application No. 201880090257.7, 6 pages.
Japanese Office Action with English translation mailed Apr. 21, 2022, received in Japanese Patent Application No. 2021-075166, 7 pages.
Chinese Office Action with English Summary issued Sep. 16, 2022, received in Chinese Patent Application No. 202111652130.X, 12 pages.

(56) References Cited

OTHER PUBLICATIONS

US Office Action mailed Aug. 12, 2022, received in U.S. Appl. No. 16/229,363, 11 pages.
Chinese Office Action with English Summary issued Oct. 12, 2022, received in Chinese Patent Application No. 202110308172.5, 9 pages.
U.S. Office Action mailed Nov. 18, 2022, received in U.S. Appl. No. 17/170,331, 9 pages.

* cited by examiner

AGITATOR WITH DEBRIDER AND HAIR REMOVAL

CROSS REFERENCE TO RELATED APPLICATIONS

The present application is a continuation of co-pending application Ser. No. 17/182,090 filed Feb. 22, 2021, which is a continuation of application Ser. No. 15/917,598 filed Mar. 10, 2018, which claims the benefit of U.S. Provisional Patent Application Ser. No. 62/469,853, filed Mar. 10, 2017, all of which are fully incorporated herein by reference.

TECHNICAL FIELD

This specification relates to surface cleaning apparatuses, and more particularly, to agitators for reducing and/or preventing hair from becoming entangled and systems/methods for removing collected hair without the user having to contact the hair.

BACKGROUND INFORMATION

The following is not an admission that anything discussed below is part of the prior art or part of the common general knowledge of a person skilled in the art.

A surface cleaning apparatus may be used to clean a variety of surfaces. Some surface cleaning apparatuses include a rotating agitator (e.g., brush roll). One example of a surface cleaning apparatus includes a vacuum cleaner which may include a rotating agitator as well as vacuum source. Non-limiting examples of vacuum cleaners include robotic vacuums, upright vacuum cleaners, canister vacuum cleaners, stick vacuum cleaners, and central vacuum systems. Another type of surface cleaning apparatus includes powered broom which includes a rotating agitator (e.g., brush roll) that collects debris, but does not include a vacuum source.

While the known surface cleaning apparatuses are generally effective at collecting debris, some debris (such as hair) may become entangled in the agitator. The entangled hair may reduce the efficiency of the agitator, and may cause damage to the motor and/or gear train that rotates the agitator. Moreover, it may be difficult to remove the hair from the agitator because the hair is entangled in the bristles.

BRIEF DESCRIPTION OF THE DRAWINGS

These and other features advantages will be better understood by reading the following detailed description, taken together with the drawings wherein.

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
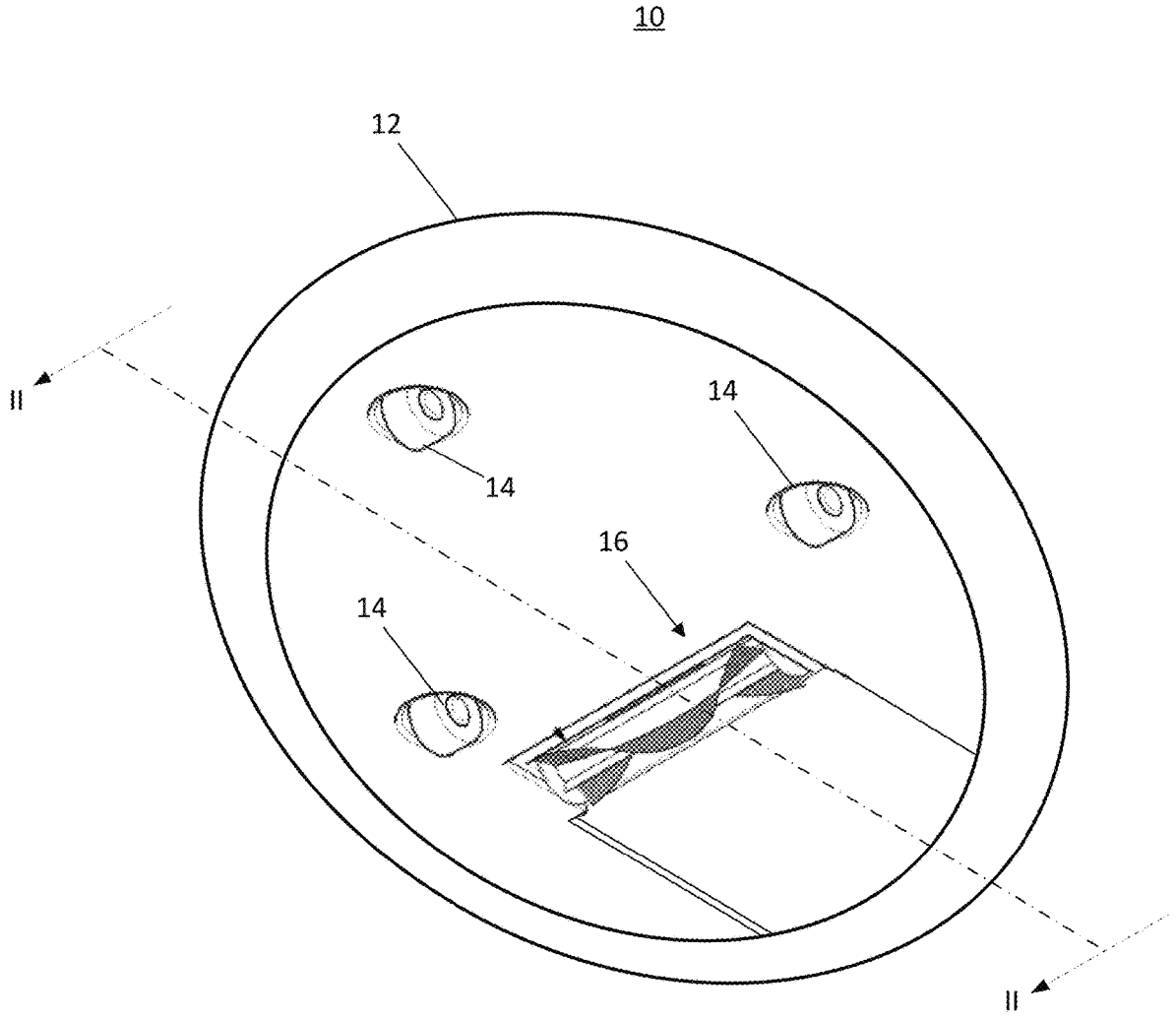
FIG. 1 is a bottom view of one embodiment of a surface cleaning apparatus, consistent with the present disclosure.

FIG. 1 illustrates a bottom perspective view of one embodiment of a surface cleaning apparatus such as a robot cleaning apparatus 10. The robot cleaning apparatus 10 may include a body or housing 12, one or more drive devices 14 (such as, but not limited to, one or more wheels and/or tracks driven by one or more electric motors and/or gears), and one or more cleaning devices 16. While not shown for clarity, the robot cleaning apparatus 10 may also include one or more controllers, motors, sensors, and/or power sources (e.g., but not limited to, one or more batteries) disposed within and/or coupled to the body 12. As is well understood, the controllers, motors, sensors (and the like) may be used to autonomously navigate the robot cleaning apparatus 10 in a space such that the cleaning devices 16 picks-up (e.g., sweeps up) and collects debris (for example, optionally using suction airflow).

Figure 2:
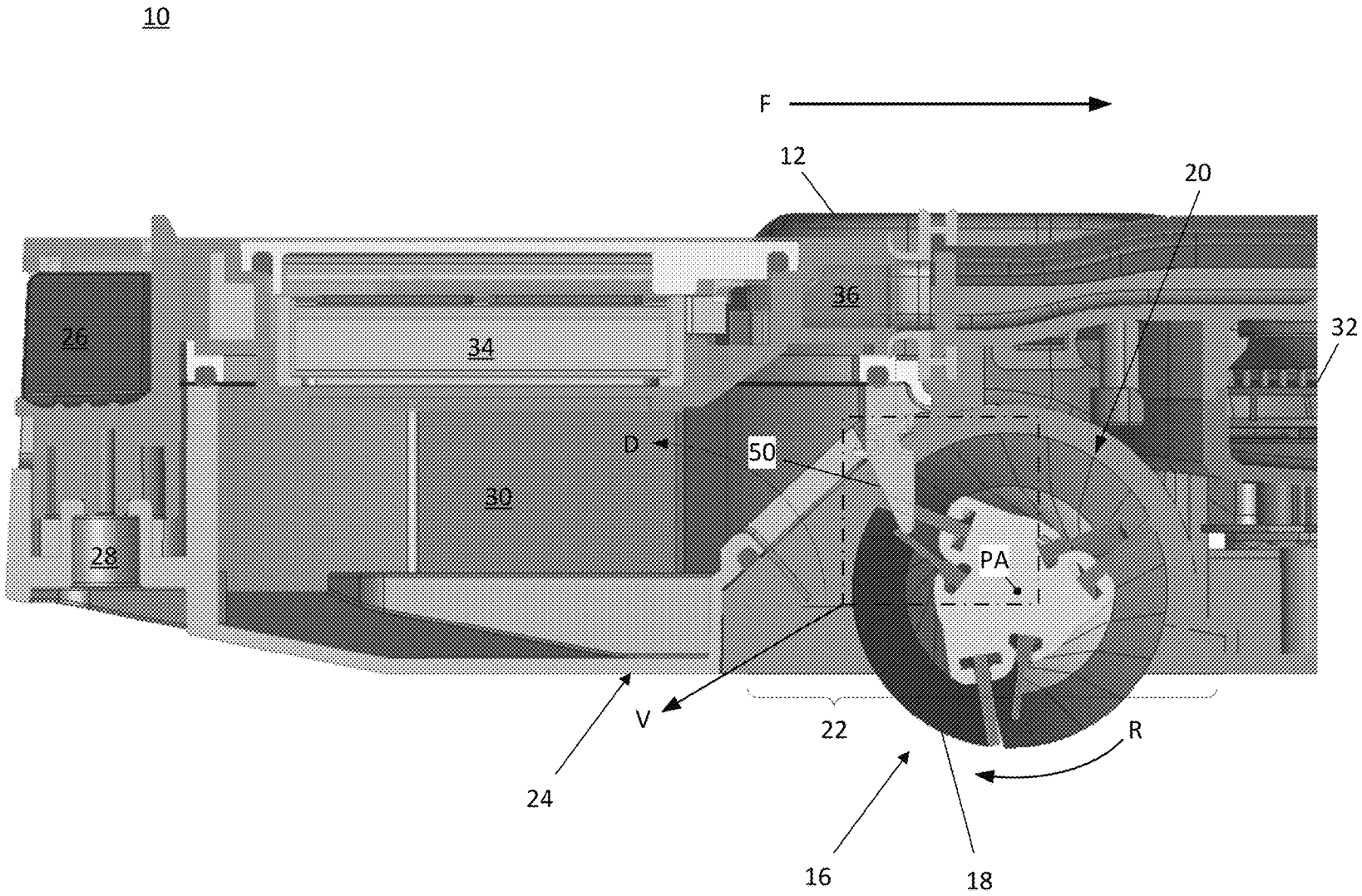
FIG. 2 is a cross-sectional view of the surface cleaning apparatus of FIG. 1 taken along line II-II.

Turning now to FIG. 2, a cross-sectional view of the robot cleaning apparatus 10 taken along lines II-II of FIG. 1 is generally illustrated. In the illustrated embodiment, the forward direction of travel of the robot cleaning apparatus 10 is generally illustrated by arrow F. The cleaning device 16 may include one or more agitators 18 that are rotatably driven at least partially within one or more agitator chambers 20 disposed within/defined by the body 12. The agitator chambers 20 include one or more openings 22 defined within and/or by a portion of the bottom surface/plate 24 of the body 12. The agitator 18 is configured to be coupled to the body 12 (either permanently or removably coupled thereto) and is configured to be rotated about a pivot axis PA (e.g., in the direction and/or reverse direction of arrow R) within the agitator chambers 20 by one or more rotation systems 26. The rotation systems 26 may be at least partially disposed in the vacuum body 12, and may one or more motors 28 (either AC and/or DC motors) coupled to one or more belts and/or gear trains (not shown) for rotating the agitators 18.

When rotated, the agitator 18 is configured pickup and/or sweep debris into one or more debris collection chambers 30 (e.g., dust bins), e.g., as generally illustrated by arrow D. The debris collection chambers 30 may be either permanently or removably coupled to the body 12, and are configured to be in fluid communication with the agitator chamber 20 such that debris collected by the rotating agitator 18 may be stored. Optionally, the agitator chamber 20 and debris chamber 30 are fluidly coupled to a vacuum source 32 (e.g., a vacuum pump or the like) for generating a partial vacuum in the agitator chamber 20 and debris collection chamber 30 and to suck up debris proximate to the agitator chamber 22 and/or agitator 18. As may be appreciated, the rotation of the agitator 18 may aid in agitating/loosening debris from the cleaning surface. Optionally, one or more filters 34 may be provided to remove any debris (e.g., dust particles or the like) entrained in the partial vacuum air flow. The debris chamber 30, vacuum source 32, and/or filters 34 may be at least partially located in the body 12. Additionally, one or more tubes, ducts, or the like 36 may be provided to fluidly couple the debris chamber 30, vacuum source 32, and/or filters 34.

Figure 3:
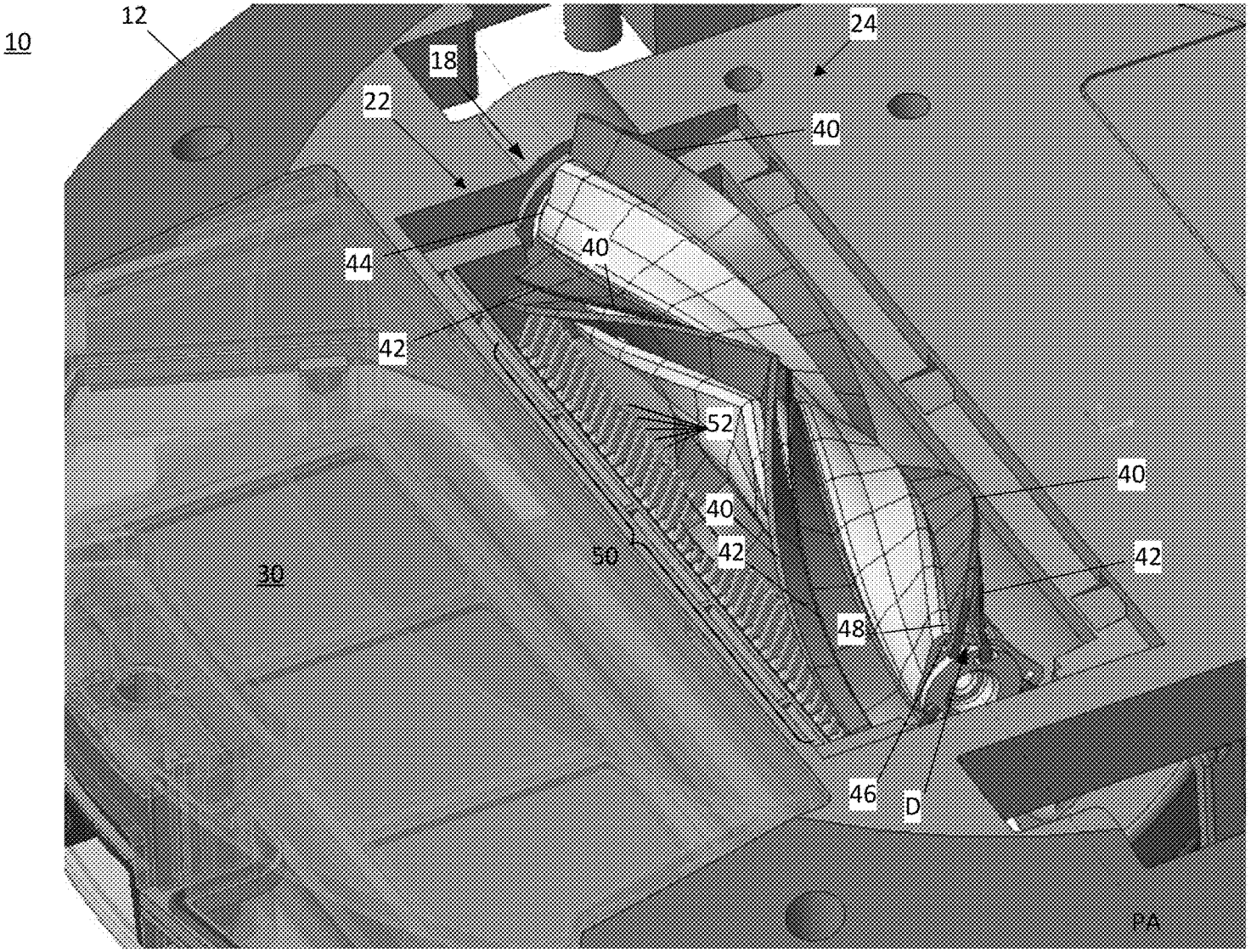
FIG. 3 is another bottom view of one embodiment of the surface cleaning apparatus of FIG. 1.

With reference to FIG. 3, the agitator 18 may includes an elongated agitator body 44 that is configured to extend along and rotate about a longitudinal/pivot axis PA. The agitator 18 (e.g., but not limited to, one or more of the ends of the agitator 18) is permanently or removably coupled to the body 12 and may be rotated about the pivot axis PA by the rotation system 26. The agitator 18 may come into contact with elongated debris such as, but not limited to, hair, string, fibers, and the like (hereinafter collectively referred to as hair for ease of explanation). The hair may have a length that is much longer than the circumference of the agitator 18. By way of a non-limiting example, the hair may have a length that is 2-10 times longer than the circumference of the agitator 18. Because of the rotation of the agitator 18 as well as the length and flexibility of the hair, the hair will tend to wrap around the circumference of the agitator 18.

As may be appreciated, an excessive amount of hair building up on the agitator 18 may reduce the efficiency of the agitator 18 and/or causing damage to the robot cleaning apparatus 10 (e.g., the rotation systems 24 or the like). To address the problem of hair wrapping around the agitator 18, the agitator 18 includes a plurality of bristles 40 aligned in one or more rows or strips as well as one or more sidewalls and/or continuous sidewalls 42 adjacent to at least one row of bristles 40. The rows of bristles 40 and continuous sidewall 42 are configured to reduce hair from becoming entangled in the bristles 40 of the agitator 18. Optionally, the combination of the bristles and sidewall 42 may be configured to generate an Archimedes screw force that urges/causes the hair to migrate towards one or more collection areas and/or ends of the agitator 18. The bristles 40 may include a plurality of tufts of bristles 40 arranged in rows and/or one or more rows of continuous bristles 40.

The plurality of bristles 40 extend outward (e.g., generally radial outward) from the elongated agitator body 44 (e.g., a base portion 46) to define one or more continuous rows. One or more of the continuous rows of bristles 40 may be coupled (either permanently or removably coupled) to the elongated agitator body 44 (e.g., to a base region 46 of the body 44) using one or more form locking connections (such as, but not limited to, a tongue and groove connection, a T-groove connection, or the like), interference connections (e.g., interference fit, press fit, friction fit, Morse taper, or the like), adhesives, fasteners overmoldings, or the like.

The rows of bristles 40 at least partially revolve around and extend along at least a portion of the longitudinal axis/pivot axis PA of the elongated agitator body 44 of the agitator 18. As defined herein, a continuous row of bristles 40 is defined as a plurality of bristles 40 in which the spacing between adjacent bristles 40 along the axis of rotation 20 is less than or equal to 3 times the largest cross-sectional dimension (e.g., diameter) of the bristles 40.

As mentioned above, the plurality of bristles 40 are aligned in and/or define at least one row that at least partially revolves around and extends along at least a portion of the longitudinal axis/pivot axis PA of the elongated agitator body 44 of the agitator 18. For example, at least one of the rows of bristles 40 may be arranged in a generally helical, arcuate, and/or chevron configuration/pattern/shape. Optionally, one or more of the rows of bristles 40 (e.g., the entire row or a portion thereof) may have a constant pitch (e.g., constant helical pitch). Alternatively (or in addition), one or more of the rows of bristles 40 (e.g., the entire row or a portion thereof) may have a variable pitch (e.g., variable helical pitch). For example, at least a portion of the row of bristles 40 may have a variable pitch that is configured to accelerate the migration of hair and/or generally direct debris towards the debris collection chamber 30.

At least one row of bristles 40 is proximate to (e.g., immediately adjacent to) at least one sidewall 42. The sidewall 42 may be disposed as close as possible to the nearest row of bristles 40, while still allowing the bristles 40 to bend freely left-to-right. For example, one or more of the sidewalls 42 may extend substantially continuously along the row of bristles 40. In one embodiment, at least one sidewall 42 extends substantially parallel to at least one of the rows of bristles 40. As used herein, the term "substantially parallel" is intended to mean that the separation distance between the sidewall 42 and the row of bristles 40 remains within 15% of the greatest separation distance along the entire longitudinal length of the row of bristles 40. Also, as used herein, the term "immediately adjacent to" is intended to mean that no other structure feature or element having a height greater than the height of the sidewall 42 is disposed between the sidewall 42 and a closest row of bristles 40, and that the separation distance D between the sidewall 42 and the closest row of bristles 40 is less than, or equal to, 5 mm (for example, less than or equal to 3 mm, less than or equal to 2.5 mm, less than or equal to 1.5 mm, and/or any range between 1.5 mm to 3 mm).

One or more of the sidewalls 42 may therefore at least partially revolve around and extend along at least a portion of the longitudinal axis/pivot axis PA of the elongated agitator body 44 of the agitator 18. For example, at least one of the sidewalls 42 may be arranged in a generally helical, arcuate, and/or chevron configuration/pattern/shape. Optionally, one or more of the sidewalls 42 (e.g., the entire row or a portion thereof) may have a constant pitch (e.g., constant helical pitch). Alternatively (or in addition), one or more of the sidewalls 42 (e.g., the entire row or a portion thereof) may have a variable pitch (e.g., variable helical pitch).

While the agitator 18 is shown having a row of bristles 40 with a sidewall 42 arranged behind the row of bristles 40 as the agitator 18 rotates about the pivot axis PA, the agitator 18 may include one or more sidewalls 42 both in front of and behind the row of bristles 40. As noted above, one or more of the sidewalls 42 may extend outward from a portion of the elongated agitator body 44 as generally illustrated in FIG. 3. For example, one or more of the sidewalls 42 may extend outward from the base 46 of the elongated agitator body 44 from which the row of bristles 40 is coupled and/or may extend outward from a portion of an outer periphery 48 of the elongated agitator body 44. Alternatively (or in addition), one or more of the sidewalls 42 may extend inward from a portion of the elongated agitator body 44. For example, the radially distal-most portion of the sidewall 42 may be disposed at a radial distance from the pivot axis PA of the elongated agitator body 44 that is within 20 percent of the radial distance of the adjacent, surrounding periphery of the elongated agitator body 44, and the proximal-most portion of the sidewall 42 (i.e., the portion of the sidewall 42 which begins to extend away from the base 46) may be disposed at a radial distance that is less than the radial distance of the adjacent, surrounding periphery of the elongated agitator body 44. As used herein, the term "adjacent, surrounding periphery" is intended to refer to a portion of the periphery of the elongated agitator body 44 that is within a range of 30 degrees about the pivot axis PA.

The agitator 18 may therefore include at least one row of bristles 40 substantially parallel to at least one sidewall 42. According to one embodiment, at least a portion (e.g., all) of the bristles 40 in a row may have an overall height Hb (e.g., a height measured from the pivot axis PA) that is longer than the overall height Hs (e.g., a height measured from the pivot axis PA) of at least one of the adjacent sidewalls 42. Alternatively (or in addition), at least a portion (e.g., all) of the bristles 40 in a row may have a height Hb that is 2-3 mm (e.g., but not limited to, 2.5 mm) longer than the height Hs of at least one of the adjacent sidewalls 42. Alternatively (or in addition), the height Hs of at least one of the adjacent sidewalls 42 may be 60 to 100% of the height Hb of at least a portion (e.g., all) of the bristles 40 in the row. For example, the bristles 40 may have a height Hb in the range of 12 to 32 mm (e.g., but no limited to, within the range of 18 to 20.5 mm) and the adjacent sidewall 42 may have a height Hs in the range of 10 to 29 mm (e.g., but no limited to, within the range of 15 to 18 mm).

The bristles 40 may have a height Hb that extends at least 2 mm. beyond the distal-most end of the sidewall 42. The sidewall 42 may have a height Hs of at least 2 mm from the base 52, and may up a height Hs that is 50% or less of the height Hb of the bristles 40. At least one sidewall 42 should be disposed close enough to the at least one row 46 of bristles 40 to increase the stiffness of the bristles 40 in at least one front-to-back direction as the agitator 18 is rotated during normal use. The sidewall 42 may therefore allow the bristles 40 to flex much more freely in at least one side-to-side direction compared to a front-to-back direction. For example, the bristles 40 may be 25%-40% (including all values and ranges therein) stiffer in the front-to-back direction compared to side-to-side direction. According to one embodiment, the sidewall 42 may be located adjacent to (e.g., immediately adjacent to) the row 46 of bristles 40. For example, the distal most end of the sidewall 42 (i.e., the end of the sidewall 42 furthest from the center of rotation PA) may be 0-10 mm from the row 46 of bristles 40, such as 1-9 mm from the row 46 of bristles 40, 2-7 mm from the row 46 of bristles 40, and/or 1-5 mm from the row 46 of bristles 40, including all ranges and values therein.

According to one embodiment, the sidewall 42 includes flexible and/or elastomeric. Examples of a flexible and/or elastomeric material include, but are not limited to, rubber, silicone, and/or the like. The sidewall 42 may include a combination of a flexible material and fabric. The combination of a flexible material and fabric may reduce wear of the sidewall 42, thereby increasing the lifespan of the sidewall 42. The rubber may include natural and/or synthetic, and may be either a thermoplastic and/or thermosetting plastic. The rubber and/or silicone may be combined with polyester fabric. In one embodiment, sidewall 42 may include cast rubber and fabric (e.g., polyester fabric). The cast rubber may include natural rubber cast with a polyester fabric. Alternatively (or in addition), the cast rubber may include a polyurethane (such as, but not limited to, PU 45 Shore A) and cast with a polyester fabric.

Because the sidewall 42 may be assembled on a helical path, there is a requirement for the top edge and bottom edge of the sidewall 42 to follow different helices each with a different helical radius. When a flexible material with reinforcement is selected to pass life requirements, the stretch required along these edges should be accounted for in order for the as-assembled sidewall 42 position to agree with the different helical radius and helical path of each edge (because the fiber materials of the composite sidewall 42 can reduce the flexibility of the sidewall 42). If this is not meet, then the distal end of the sidewall 42 may not be positioned at a constant distance from the bristles 40 (e.g., within 10 mm as described herein). Therefore, the sidewall 42 geometry and the material choices should be selected to satisfy the spatial/positional requirements of the sidewall 42, the flexibility required to perform the anti-wrap function, and the durability to withstand normal use in a vacuum cleaner. The addition of a fabric may be useful in higher agitator rotation speed applications (e.g., but not limited to, upright vacuum applications).

The agitator 18 (e.g., the bristles 40) should be aligned within the agitator chamber 20 such that the bristles 40 are able to contact the surface to be cleaned. The bristles 40 should be stiff enough in at least one of the directions of arrows R to engage the surface to be cleaned (e.g., but not limited to, carpet fibers) without undesirable bending (e.g., stiff enough to agitate debris from the carpet), yet flexible enough to allow side-to-side bending. Both the size (e.g., height Hs) and location of the sidewalls 42 relative to the row of bristles 40 may be configured to generally prevent and/or reduce hair from becoming entangled around the base or bottom of the bristles 40. The bristles 40 may be sized so that when used on a hard floor, it is clear of the floor in use. However, when the surface cleaning apparatus 10 is on carpet, the wheels 16 will sink in and the bristles 40 will penetrate the carpet. The length of bristles 40 may be chosen so that it is always in contact with the floor, regardless of floor surface. Additional details of the agitator 18 (such as, but not limited to, the bristles 40 and sidewall 42) are described in U.S. Patent Application Ser. No. 62/385,572 filed Sep. 9, 2016, which is fully incorporated herein by reference.

Figure 4:
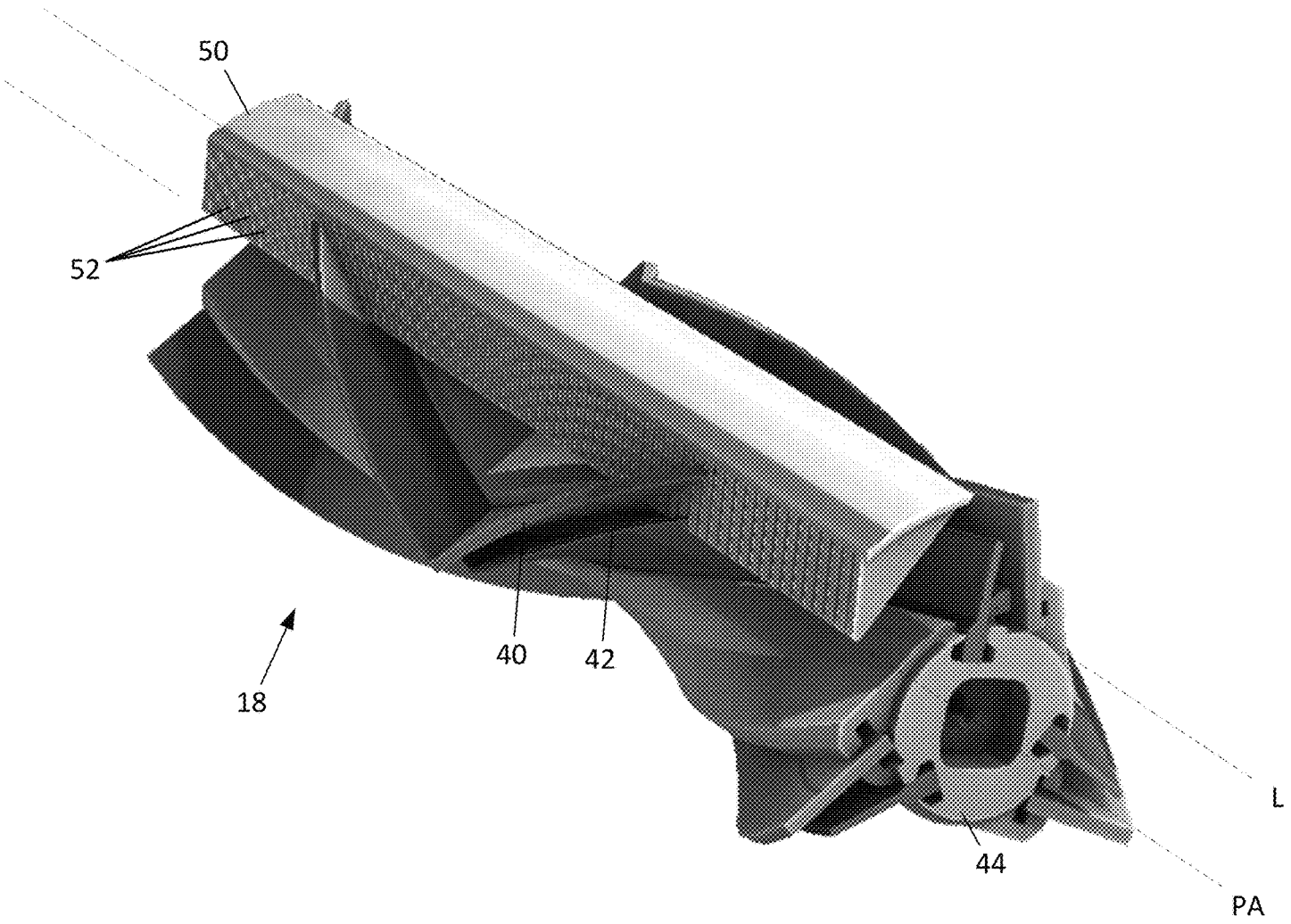
FIG. 4 is a perspective view of one embodiment of an agitator and debrider consistent with the surface cleaning apparatus of FIG. 1.

With reference to FIGS. 2 and 3, the robot cleaning apparatus 10 may also include one or more debriders 50. The debriders 50 includes a plurality of fingers, ribs, and/or teeth 52 forming a comb-like structure that extends along all or a portion of the length of the agitator 18 which includes the bristles 40 and/or sidewalls 42. The fingers 52 are configured to extend (e.g., protrude) from a portion of the robot cleaning apparatus 10 (such as, but not limited to, the body 12, agitator chamber 20, bottom surface 24, and/or debris collection chamber 30) generally towards the agitator 18 such that at a portion of the fingers 52 contact an end portion of the bristles 40 and/or one or more of the sidewalls 42. Rotation of the agitator 18 causes the fingers 52 of the debrider 50 to pass between the plurality of bristles 40 and contact one or more of the more of the sidewalls 42 (e.g., as generally illustrated in FIG. 4), thereby preventing hair from becoming entangled on the agitator 18. It should be appreciated that the shape or the fingers, ribs, and/or teeth 52 are not limited to those shown and/or described in the instant application unless specifically claimed as such.

According to one embodiment, at least some of the fingers 52 (e.g., all of the fingers 52) extend generally towards the agitator 18 such that a distal most end of the fingers 52 is within 2 mm of the sidewall 42 as the sidewall 42 rotates past the fingers 52. As such, the fingers 52 may or may not contact the sidewall 42.

Alternatively (or in addition), at least some of the fingers 52 (e.g., all of the fingers 52) extend generally towards the agitator 18 such that a distal most end of the fingers 52 contact (e.g., overlap) the sidewall 42 as the sidewall 42 rotates past the fingers 52. For example, the distal most end of the fingers 52 may contact up to 3 mm of the distal most end of the sidewall 42, for example, 1-3 mm of the distal most end of the sidewall 42, 0.5-3 mm of the distal most end of the sidewall 42, up to 2 mm of the distal most end of the sidewall 42, and/or 2 mm of the sidewall 42, including all ranges and values therein.

The fingers 52 may be placed along all or a part of the longitudinal length L of the debrider 50, for example, either evenly or randomly spaced along longitudinal length L. According to one embodiment, the density of the fingers 52 (e.g., number of fingers 52 per inch) may be in the range of 0.5-16 fingers 52 per inch such as, but not limited to, 1-16 fingers 52 per inch, 2-16 fingers 52 per inch, 4 to 16 fingers 52 per inch and/or 7-9 fingers 52 per inch, including all ranges and values therein. For example, the fingers 52 may have a 2-5 mm center to center spacing, a 3-4 mm center to center spacing, a 3.25 mm center to center spacing, a 1-26 mm center to center spacing, up to a 127 mm center to center spacing, up to a 102 mm center to center spacing, up to a 76 mm center to center spacing, up to a 50 mm center to center spacing, a 2-26 mm center to center spacing, a 2-50.8 mm center to center spacing, and/or a 1.58-25.4 mm center to center spacing, including all ranges and values therein.

The width of the fingers 52 (e.g., also referred to as teeth) may be configured to occupy a minimum width subject to manufacturing and strength requirements. The reduced width of the fingers 52 may minimize wear on the agitator 18 and facilitate airflow between the fingers 52 for clearing of hair. The collective widths of the plastic fingers 52 may be 30% or less than the total width of the debrider 50, particularly when the debrider 50 is plastic.

The width of the fingers 52 along the profile and brush roll axis PA may be based on structural and molding requirements. The profile of the distal end of the fingers 52 may be arcuate (e.g., rounded) or may form a sharp tip (e.g., the leading edge 54 and the trailing edge 56 may intersect at the inflection point to form an acute angle). According to one embodiment, the profile of the distal end of the fingers 52 may be rounded and smooth, based on material and production factors. For example, the profile of the distal end of the fingers 52 may be 0.6-2.5 mm in diameter (such as, but not limited to, 1-2 mm in diameter and/or 1.6 mm in diameter) for a 28 mm diameter agitator 18.

The root gap of the fingers 52 (e.g., the transition between adjacent fingers 52) may have a radial gap clearance that is from 0 to 15% of the major diameter of the agitator 18. For example, the root gap of the fingers 52 may be between 2-7% of the major diameter of the agitator 18 such as, but not limited to, 3-6% of the major diameter of the agitator 18 and/or 5.4% of the major diameter of the agitator 18. By way of a non-limiting example, the root gap of the fingers 52 may be a 1.5 mm gap for a 28 mm agitator 18.

While the fingers 52 are illustrated being spaced in a direction extending along a longitudinal length L of the debrider 50 that is generally parallel to the pivot axis PA of the agitator 18, it should be appreciated that all or a portion of the fingers 52 may extend along one or more axes (e.g., a plurality of axes) in one or directions that are transverse to the pivot axis PA (e.g., but not limited to, a V shape).

Figure 5:
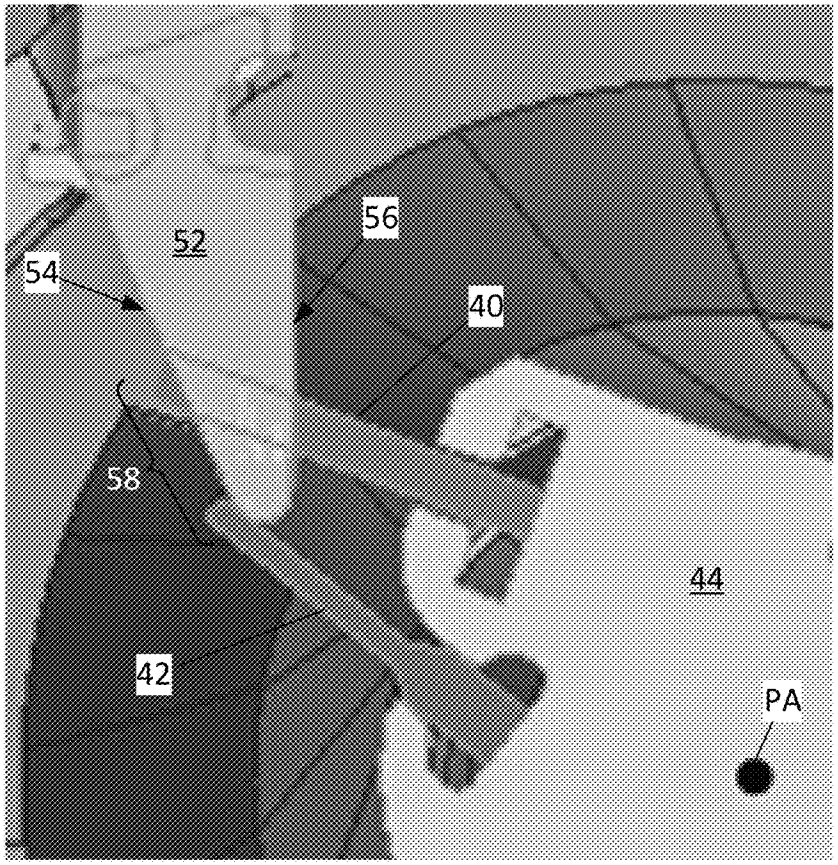
FIG. 5 is close up of region V in FIG. 2.

Turning now to FIG. 5 which is a close up of region V in FIG. 2, the fingers 52 include a leading edge 54 and a trailing edge 56. The leading edge 54 is defined as the portion (e.g., surface) of the finger 52 which faces towards and initially contacts the agitator 18 (e.g., the bristles 40) as the agitator 18 rotates during normal use, while the trailing edge 56 is defined as the generally opposite side of the finger 52. The region of the leading edge 54 that contact/engages the bristles 40 is defined as the engagement portion (e.g., surface) 58.

Figure 6:
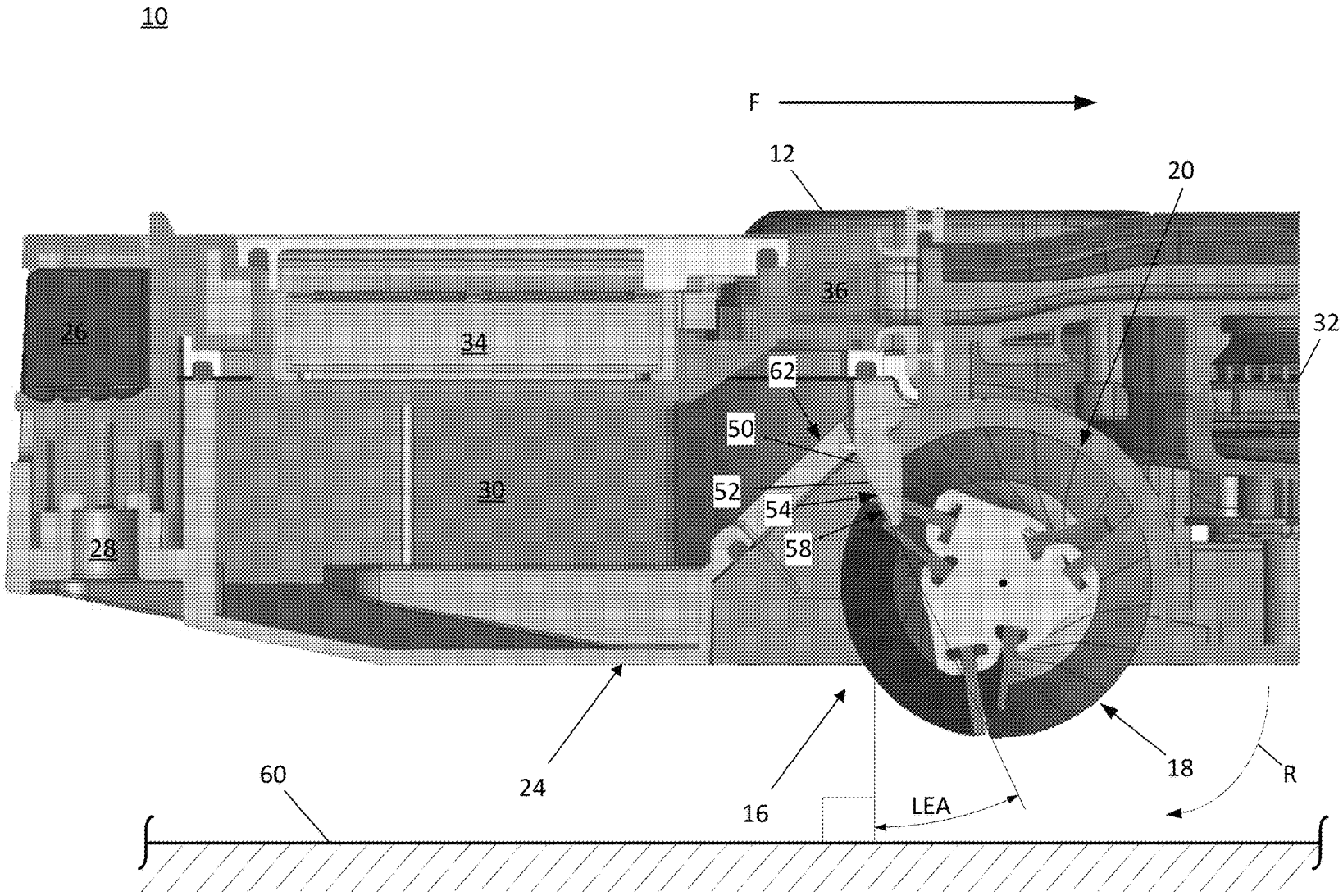
FIG. 6 is a cross-sectional view illustrating one embodiment of the angle LEA of the engagement portion of a leading edge of a finger.
Figure 7:
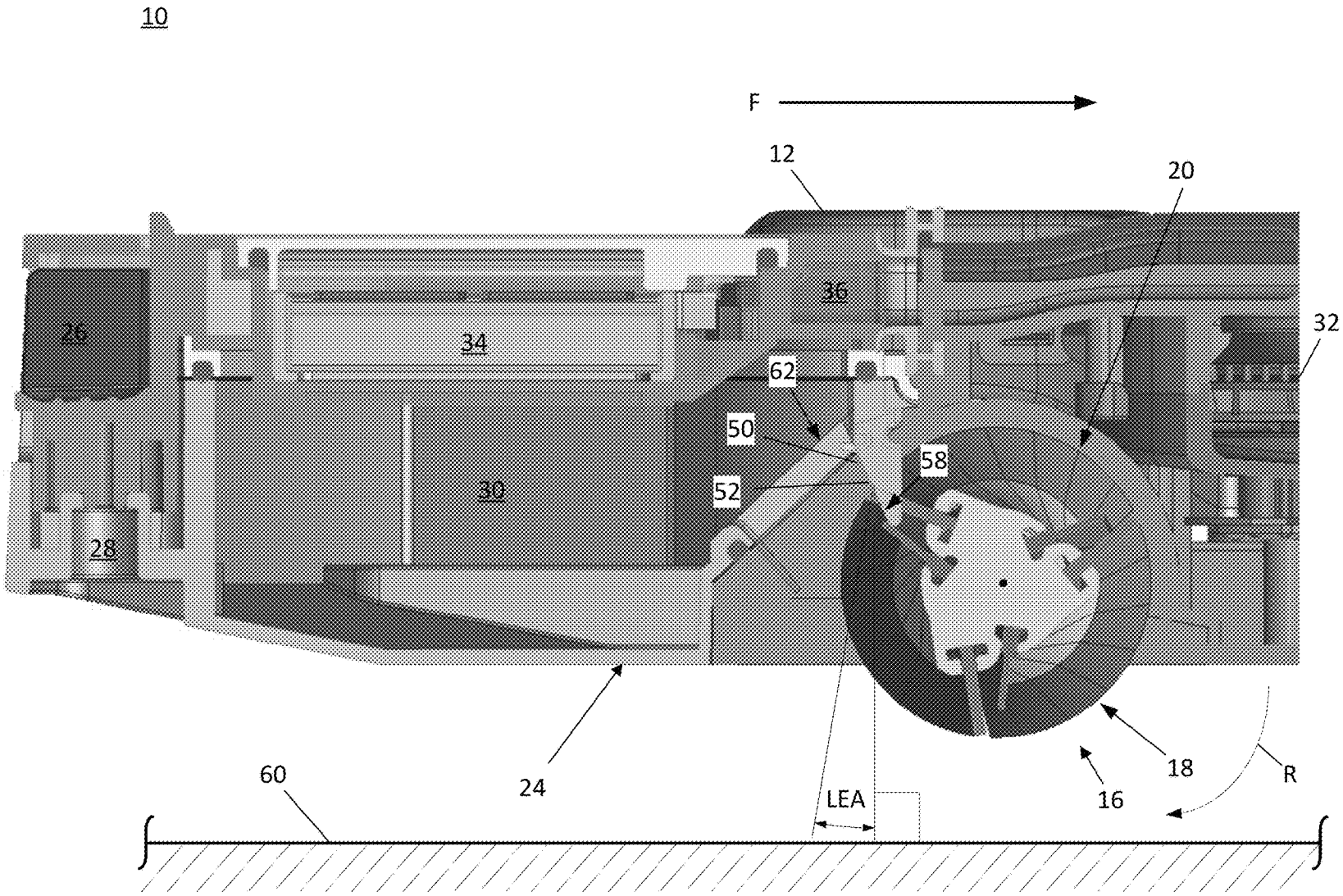
FIG. 7 is a cross-sectional view illustrating another embodiment of the angle LEA of the engagement portion of a leading edge of a finger.

With reference to FIGS. 6 and 7, the debrider 50 may be located within the agitator chamber 20 such that the fingers 52 contact the agitator 18 in a region where the bristles 40 of the agitator 18 are moving generally upward (e.g., away from the surface 60 to be cleaned). For example, the debrider 50 may be disposed proximate to an upper portion of the entrance/inlet 62 to the debris collection chamber 30. In at least one embodiment, the debris collection chamber 30 may be removable from the body 12 and the debrider 50 may be coupled to the debris collection chamber 30 such that the debrider 50 is removed from the body 12 with the debris collection chamber 30.

The engagement portion 58 of at least one leading edge 54 of a finger 52 may be disposed at an angle LEA that may be defined as the angle formed by a straight line extending between the inner and outer most positions of the engagement portion 58 (excluding the tip radius, if any) and a line extending normal from the outer most position of the engagement portion 58. According to this definition, the angle LEA may be between 0 and 40 degrees in the direction towards the front of the robot cleaning apparatus 10 (e.g., generally in the direction of arrow F) as shown in FIG. 6, and/or may be between 0 and 5 degrees in the direction towards the back of the robot cleaning apparatus 10 (e.g., generally opposite the direction of arrow F) as shown in FIG. 7 (please note that the engagement portion 58 in FIG. 7 is not shown within the described region, however, the lines defining LEA in FIG. 7 correspond to the recited description).

Figure 8:
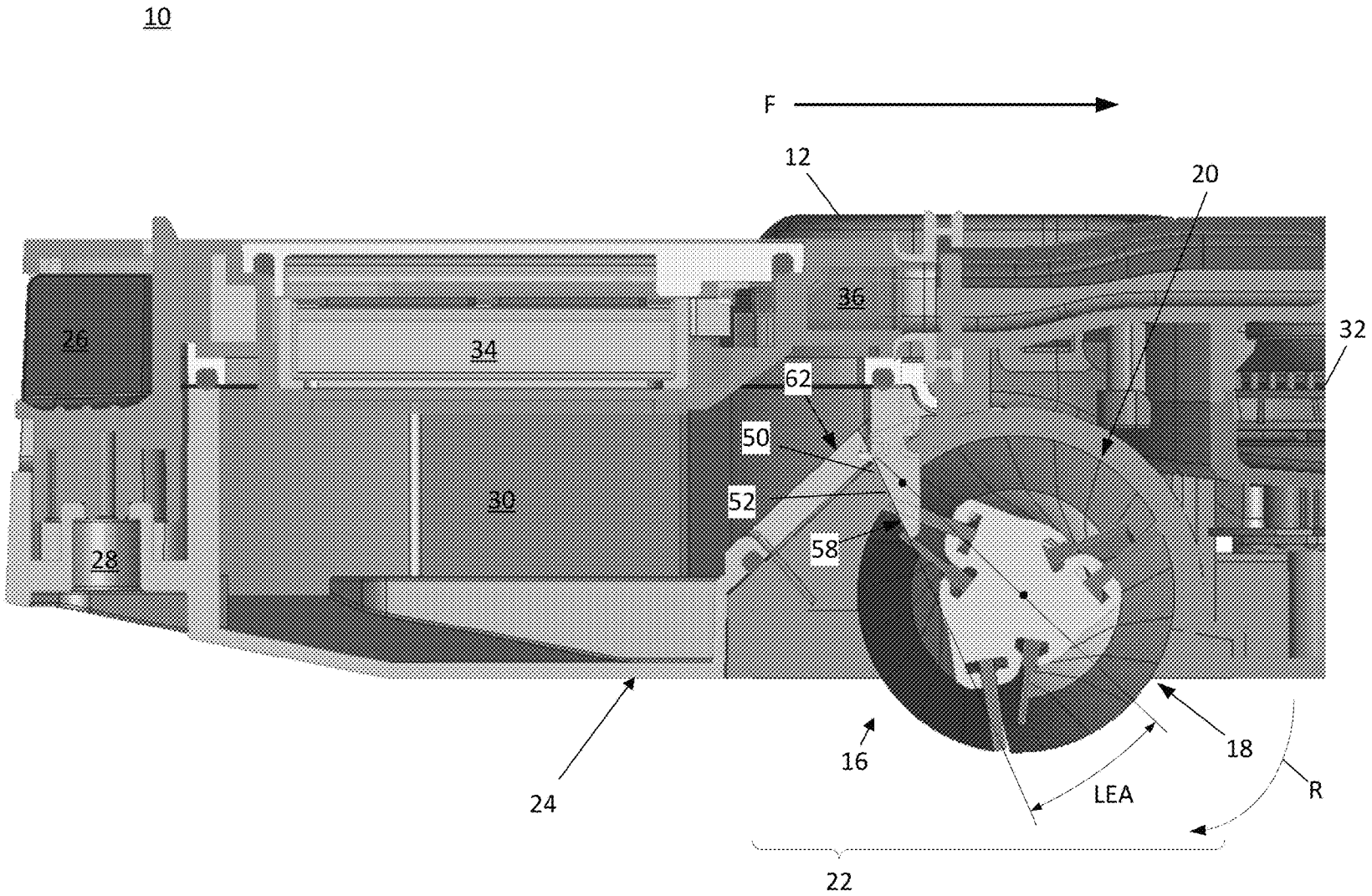
FIG. 8 is a cross-sectional view illustrating yet another embodiment of the angle LEA of the engagement portion of a leading edge of a finger.
Figure 9:
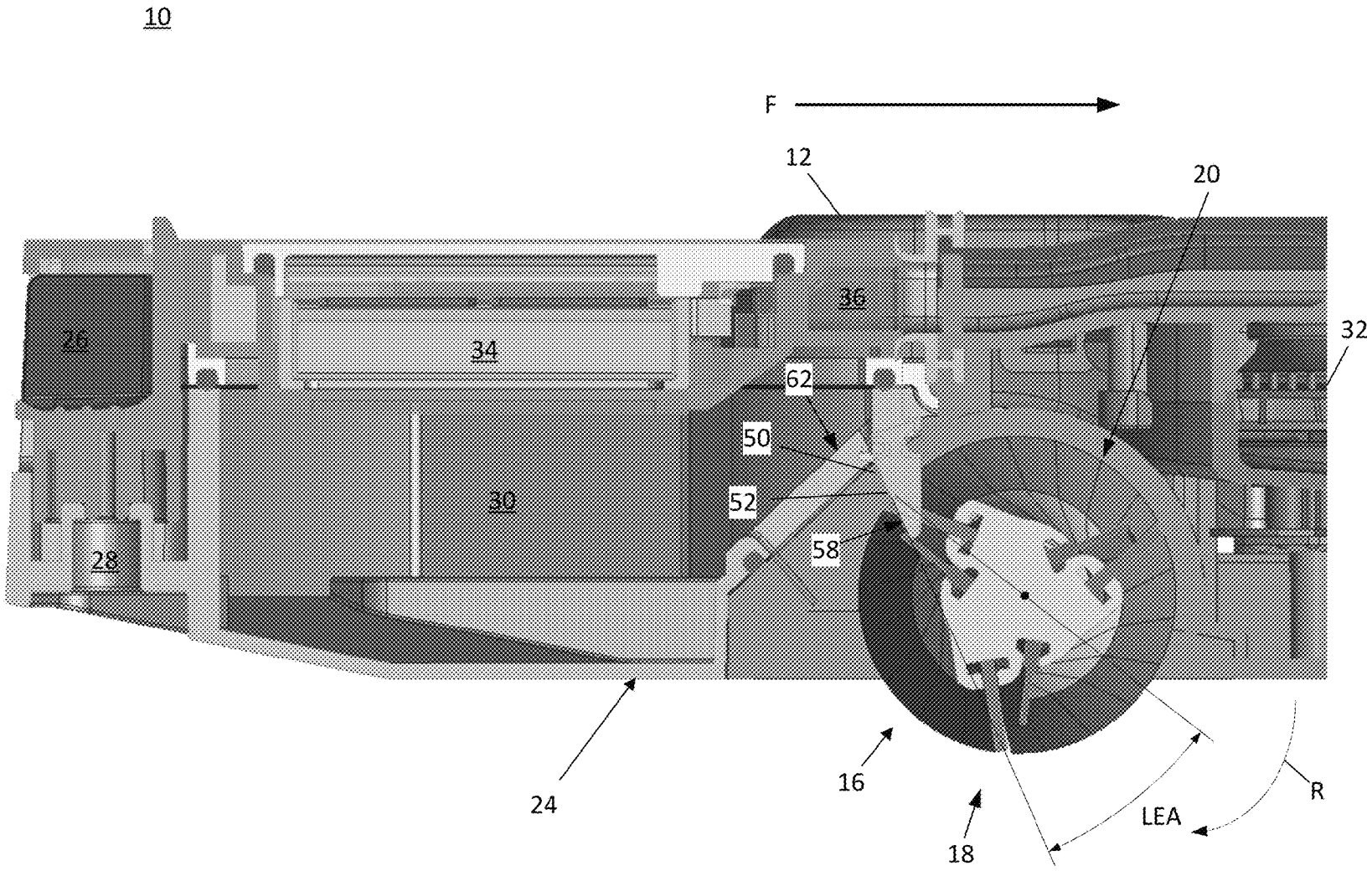
FIG. 9 is a cross-sectional view illustrating a further embodiment of the angle LEA of the engagement portion of a leading edge of a finger.

As noted herein, the debrider 50 may be located anywhere within the agitator chamber 20 and/or opening 22. According to one embodiment, the angle LEA of the engagement portion 58 of at least one leading edge 54 of a finger 52 may be defined as the angle formed by a straight line extending between the inner and outer most positions of the engagement portion 58 (excluding the tip radius, if any) and a straight line extending between a midpoint of the finger 52 at the outer most position of the engagement portion 58 and the center of rotation (e.g., pivot axis) of the agitator 18, as generally illustrated in FIG. 8. According to this definition, the angle LEA may be between 5 and 50 degrees. Alternatively, the angle LEA of the engagement portion 58 of at least one leading edge 54 of a finger 52 may be defined as the angle formed by a straight line extending between the inner and outer most positions of the engagement portion 58 (excluding the tip radius, if any) and a straight line extending between the outer most position of the engagement portion 58 and the center of rotation (e.g., pivot axis) of the agitator 18, as generally illustrated in FIG. 9. According to this definition, the angle LEA may be between 5 and 60 degrees and/or between 15 and 90 degrees, for example, 25 degrees. In all cases, a straight line extending between the inner and outer most positions of the engagement portion 58 does not pass through the center of rotation (e.g., pivot axis) of the agitator 18.

Figure 10:
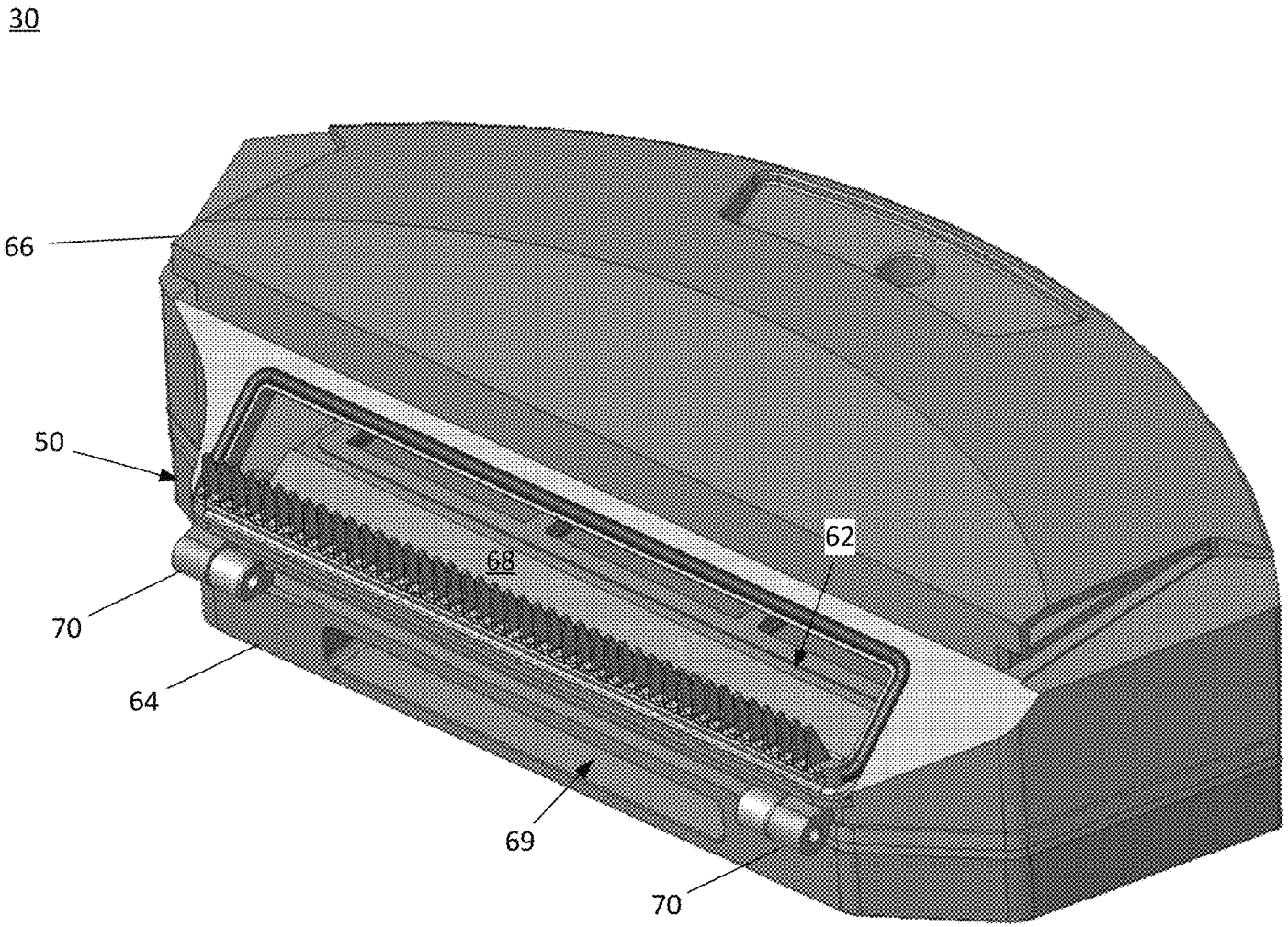
FIG. 10 is a perspective view of one embodiment of a debris collection chamber and debrider.

Turning now to FIG. 10, one embodiment of a debris collection chamber 30 is generally illustrated. The debris collection chamber 30 includes a chamber body 64 and a movable lip/cover 66 that define one or more debris collection cavities 68. The debris collection chamber 30 includes at least one entrance 62 and, optionally, one or more outlets 69 which are configured to be in fluid communication with a vacuum source/blower. As noted herein, the debrider 50 may be located proximate to the entrance 62 of the debris collection chamber 30. According to one embodiment, at least one debrider 50 may be mounted, coupled, and/or otherwise secured to the lid 66. Alternatively (or in addition), the least one debrider 50 may be mounted, coupled, and/or otherwise secured to the chamber body 64. In either embodiment, the lid 66 may optionally be coupled to the chamber body 64 by way of one or more hinges 70.

The robot cleaning apparatus 10 may also include one or more debrider cleaners. As noted herein, hair that is removed from the agitator 18 may collect on the fingers 52 of the debrider 50. This hair must be eventually removed from the debrider 50. The debrider cleaner may include a plurality of debrider cleaner fingers and/or gratings that are configured to remove the hair collected on the fingers 52 of the debrider 50 when the user moves the debrider cleaner fingers/gratings relative to the debrider 50, without the user having to contact the hair. According to one embodiment, one or more of the debriders 50 are coupled to the lid 66 and one or more of the debrider cleaner fingers/gratings are coupled to the chamber body 64. Alternatively (or in addition), one or more of the debriders 50 are coupled to the chamber body 64 and one or more of the debrider cleaner fingers/gratings are coupled to the lid 66. In either case, the debrider 50 moves relative to the debrider cleaner fingers/gratings as the user removes the lid 66 and/or swings the lid 66 open from the chamber body 64, for example, while empting the debris cavity 68 of the debris collection chamber 30.

According to yet another embodiment, at least one of the debriders 50 is configured to be retracted or extended (for example into a portion of the chamber body 64, debris cavity 68, and/or lid 66) and the debrider cleaner fingers/gratings remain substantially stationary. Alternatively (or in addition), at least one of the debrider cleaner fingers/gratings is configured to be retracted or extended (for example into a portion of the chamber body 64, debris cavity 68, and/or lid 66) and the debriders 50 remain substantially stationary. In all cases, the debrider cleaner fingers/gratings are in configured to move within close proximity to (e.g., within 1 mm) and/or contact the fingers 52 of the debrider 50 during the relative movement of the debrider cleaner fingers/gratings and debrider 50.

Figure 11:
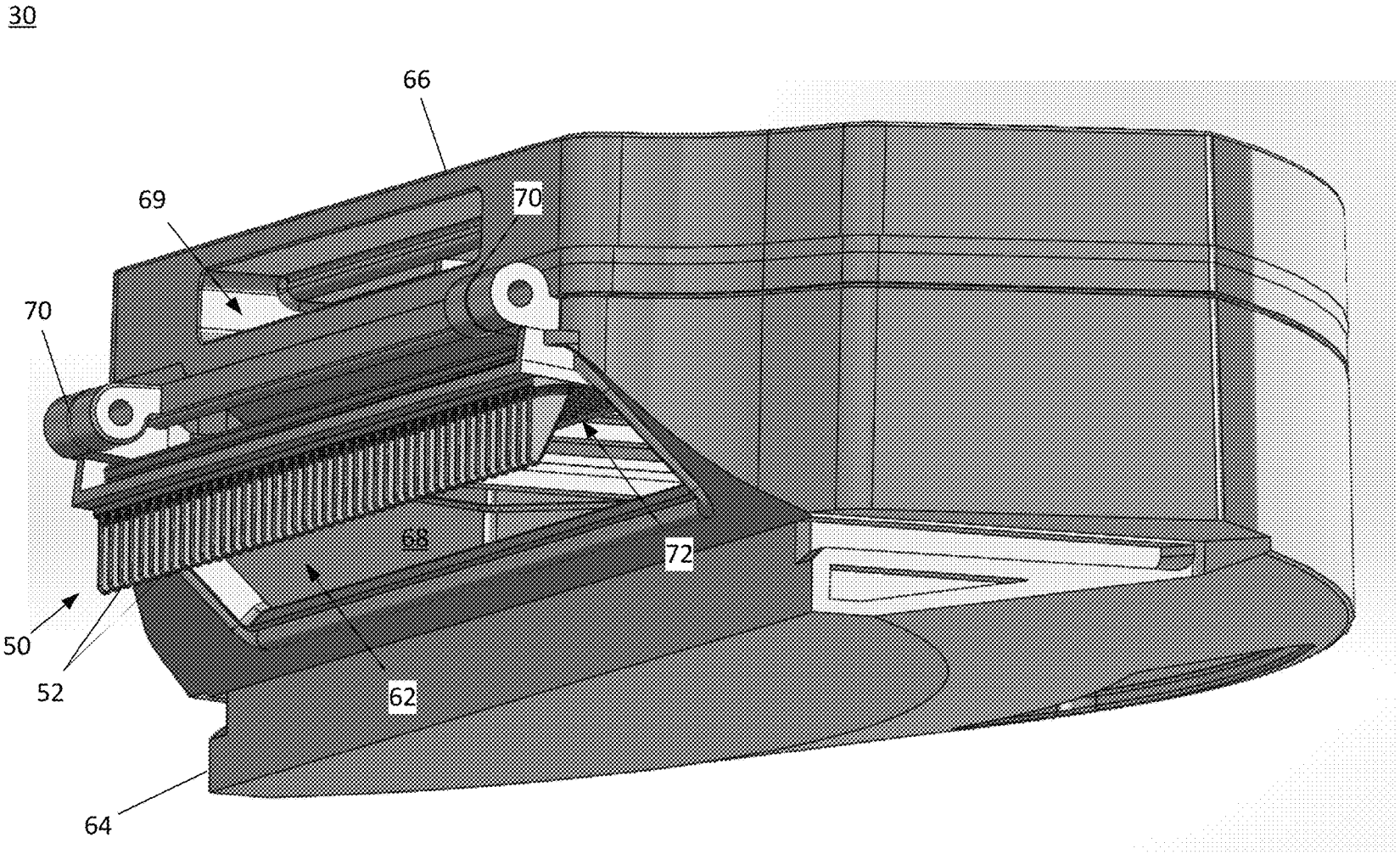
FIG. 11 is a perspective view of another embodiment of a debris collection chamber, debrider, and a lid in a closed position.
Figure 12:
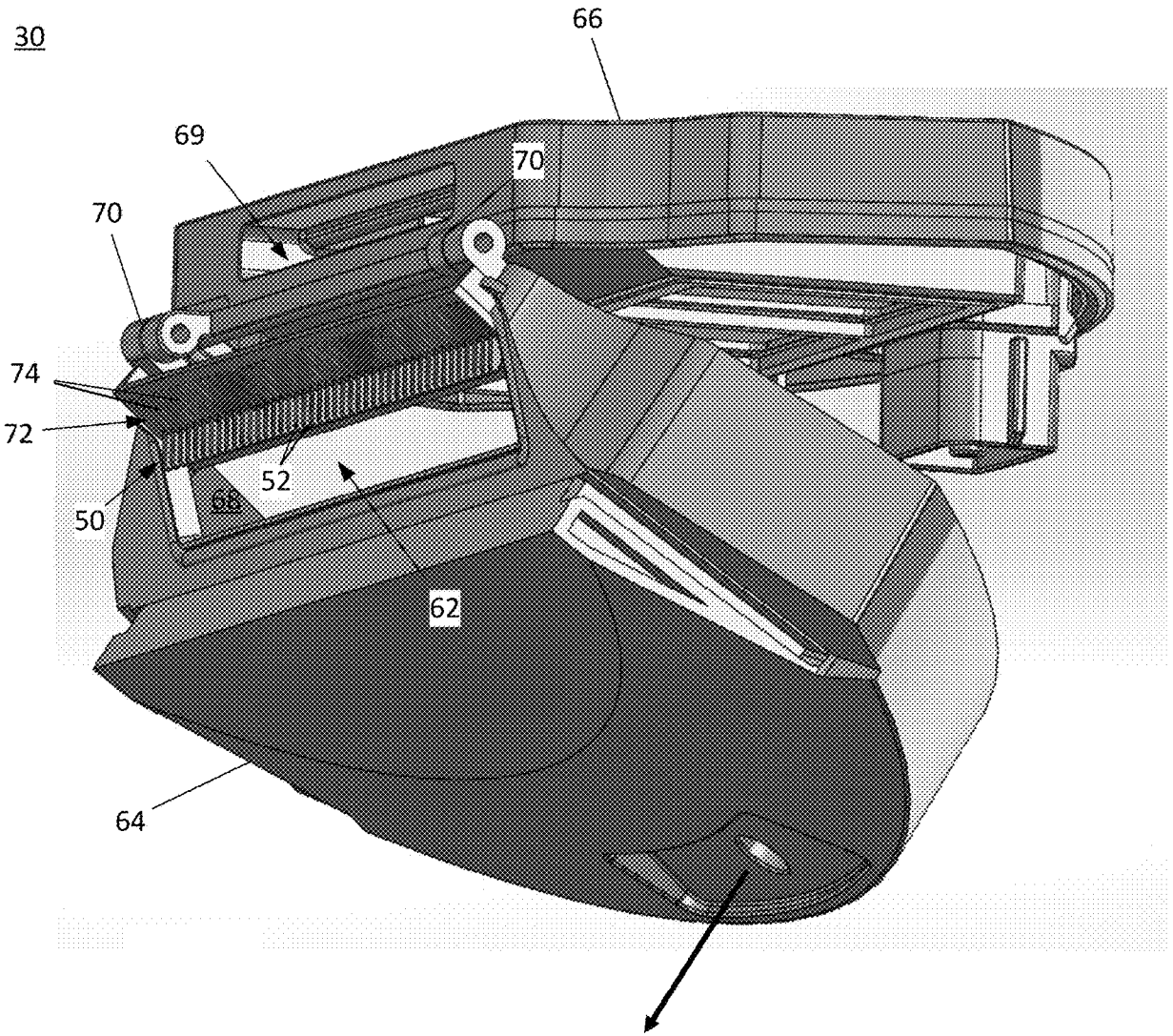
FIG. 12 is a perspective view of the debris collection chamber, debrider, debrider cleaner, and a lid of FIG. 11 in an open position.

With reference to FIGS. 11 and 12, one embodiment of the debrider 50 and the debrider cleaner 72 is generally illustrated. The debrider 50 is coupled to the lid 66 and the debrider cleaner 72 is coupled to the chamber body 64. The debrider 50 is located at the entrance/inlet 62 of the debris collection chamber 30 and in close proximity to the exit from the agitator chamber 20. The exact placement of the debrider 50 may be dictated by optimum placement of the debrider 50 relative to the agitator 18 to collect/remove hair from the agitator 18.

Figure 13:
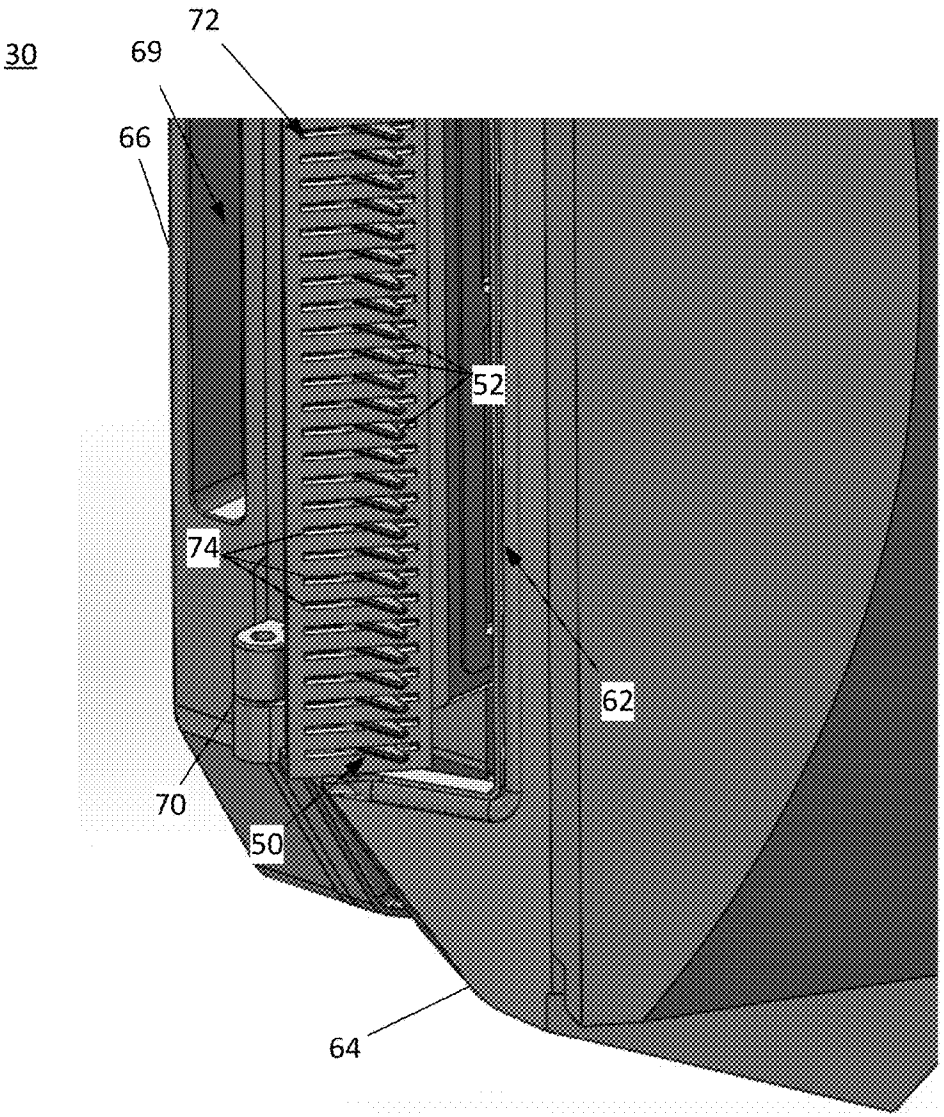
FIG. 13 is another perspective view of the debris collection chamber, debrider, debrider cleaner, and a lid of FIG. 11 in a partially open position.

The lid 66 is coupled to the chamber body 64 by one or more hinges 70 that are located near the debrider 50 (e.g., on the same side of the debris collection chamber 30 as the debrider 50). In particular, the lid 66 is shown in the closed position in FIG. 11 and in the open position in FIG. 12. As the user moves the lid 66 from the closed position to the open position (e.g., to empty the collection cavity 68), the debrider cleaner fingers/gratings 74 of the debrider cleaner 72 (best seen in FIGS. 12 and 13) pass in close proximity to and/or contact the fingers 52 of the debrider 50, thereby removing any hair that has been collected by the fingers 52. The size of the debrider cleaner fingers/gratings 74 of the debrider cleaner 72 will be based, at least in part, on the length of the fingers 52, the position of the fingers 52 relative to the debrider cleaner fingers/gratings 74, and the position of the hinge 70 relative to the fingers 52.

Figure 14:
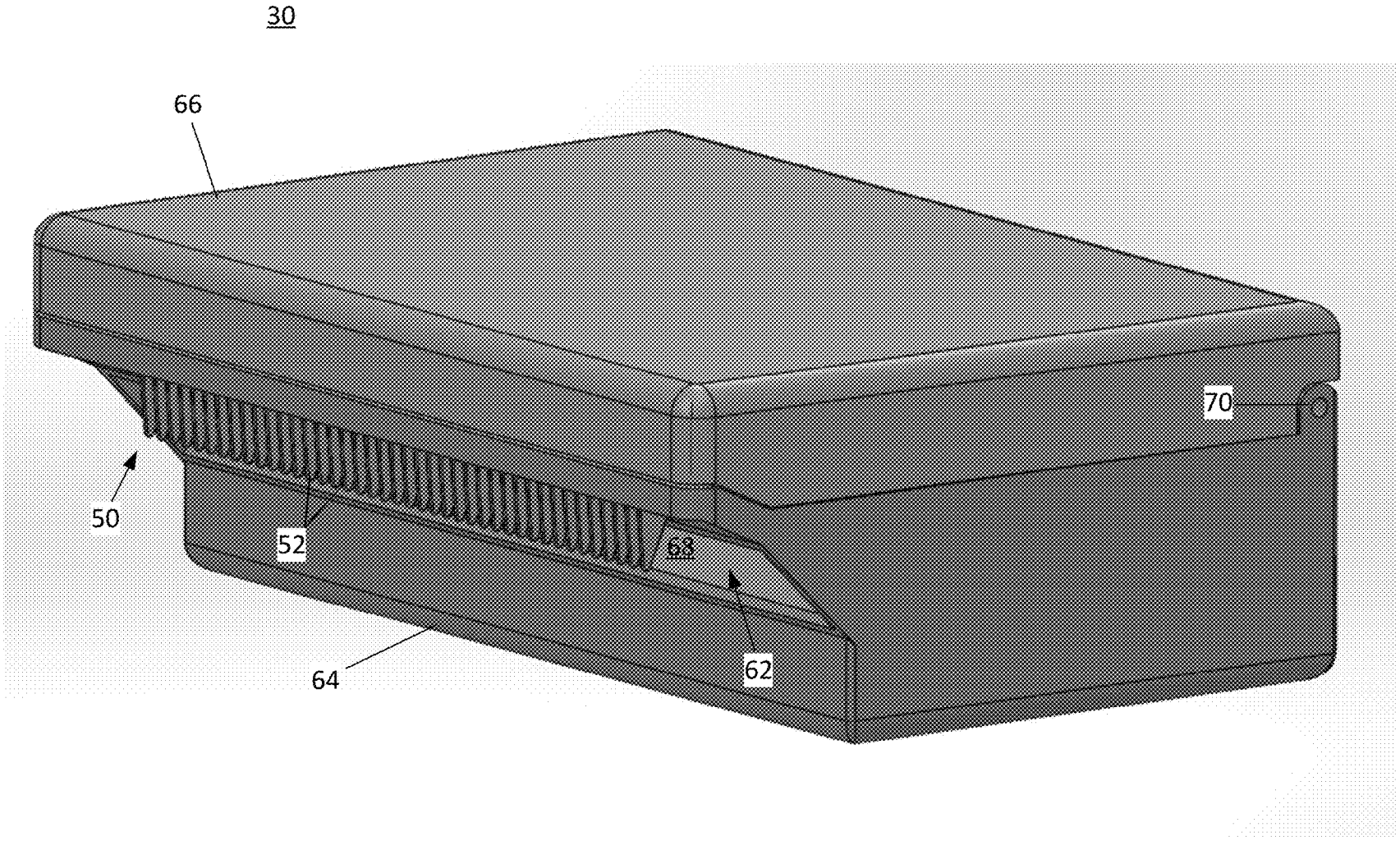
FIG. 14 is a perspective view of a further embodiment of a debris collection chamber, debrider, debrider cleaner, and a lid in a closed position.
Figure 15:
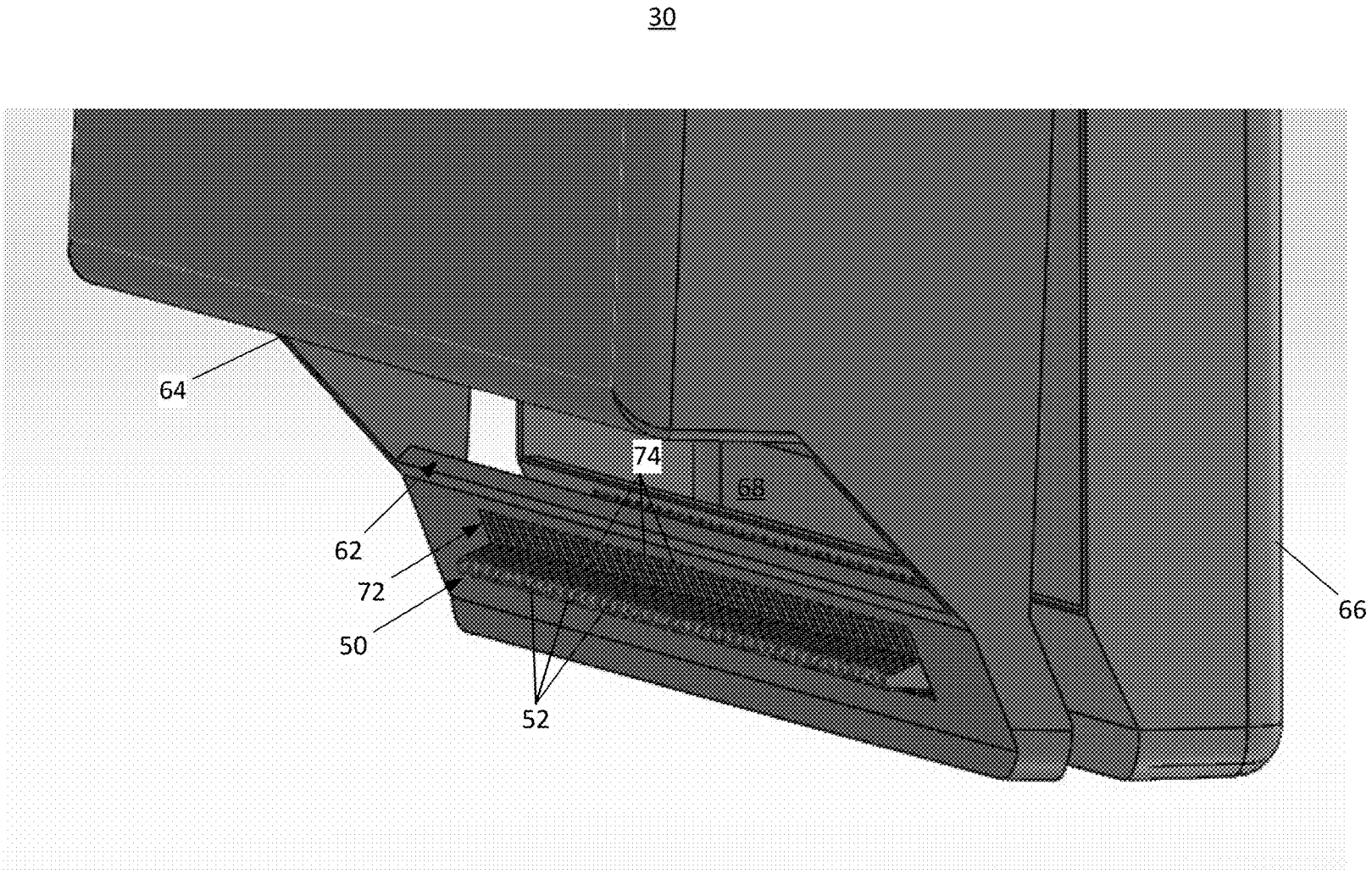
FIG. 15 is a perspective view of the debris collection chamber, debrider, debrider cleaner, and a lid of FIG. 14 in a partially open position.

Turning now to FIGS. 14 and 15, another embodiment of the debrider 50 and the debrider cleaner 72 is generally illustrated. The debrider 50 is coupled to the lid 66 and the debrider cleaner 72 is coupled to the chamber body 64. The debrider 50 is located at the entrance/inlet 62 of the debris collection chamber 30 and in close proximity to the exit from the agitator chamber 20. The exact placement of the debrider 50 may be dictated by optimum placement of the debrider 50 relative to the agitator 18 to collect/remove hair from the agitator 18. The lid 66 is coupled to the chamber body 64 by one or more hinges 70 that are located on the generally opposite side of the debris collection chamber 30 from the debrider 50.

Figure 16:
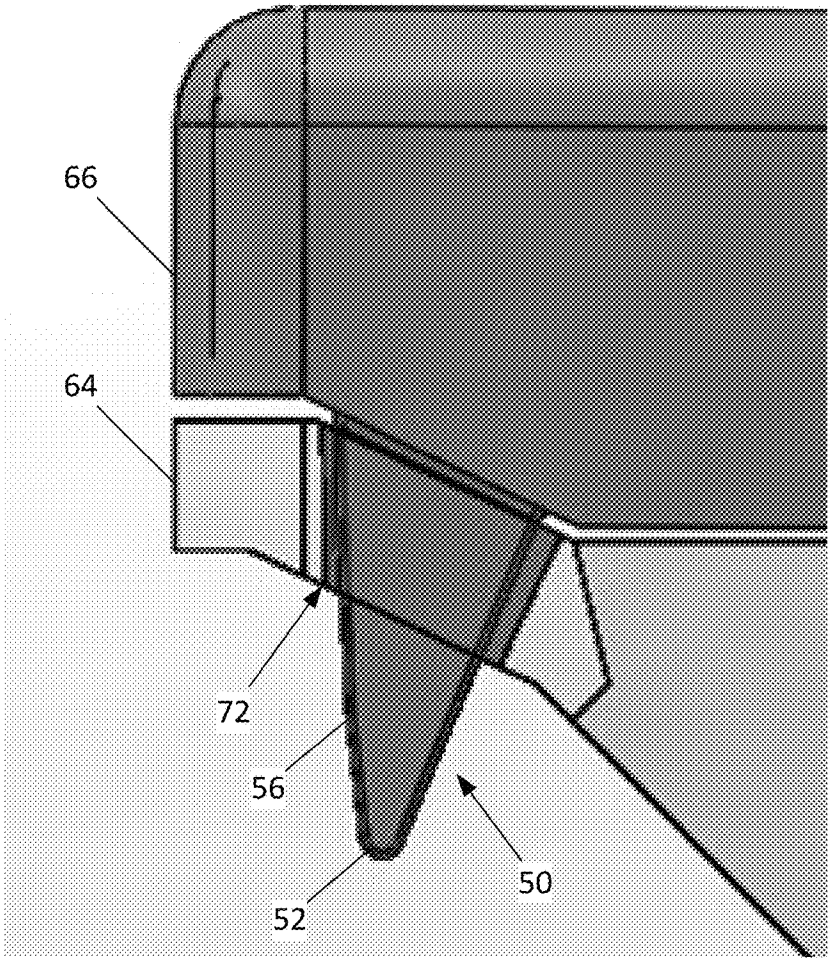
FIG. 16 is a close up of a cross-sectional view generally illustrating one embodiment of a debrider cleaner and debrider having a trailing edge with an arcuate profile.
Figure 17:
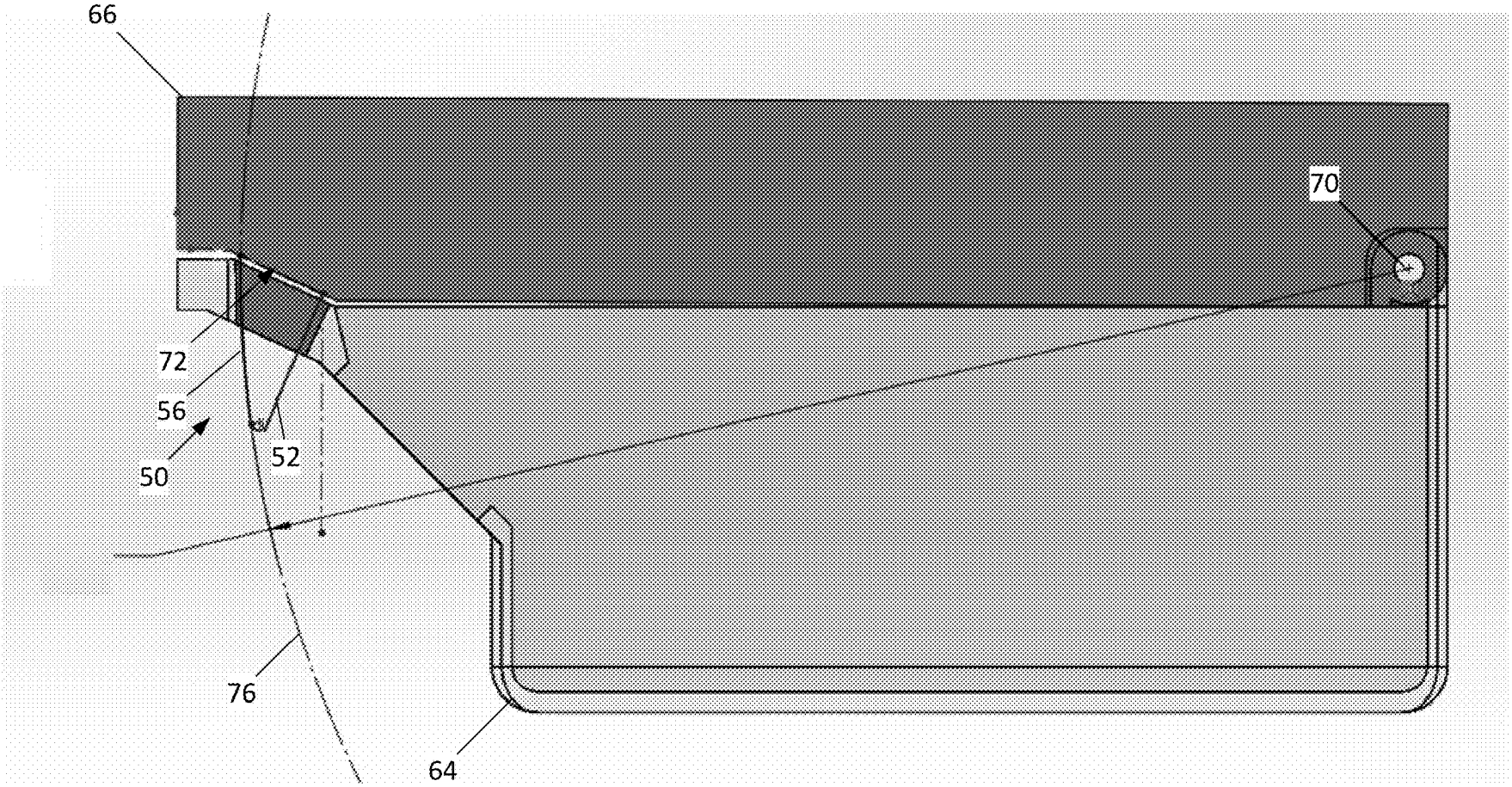
FIG. 17 is another cross-sectional view of the debrider cleaner and debrider of FIG. 16 having a trailing edge with an arcuate profile

With reference now to FIGS. 16 and 17, at least a portion of the trailing edge 56 of the fingers 52 of the debrider 50 may include an arcuate profile. In particular, the trailing edge 56 may have an arcuate profile that generally corresponds to an arc 76 that is centered at the hinge point 70 of the lid 66 and chamber body 64. When the lid 66 is opened, the fingers 52 of the debrider 50 pass through the debrider cleaner fingers/gratings 74 of the debrider cleaner 72, and the arc profile of the trailing edge 56 of the fingers 52 allows for a minimal gap and/or constant contact between the trailing edge 56 of the fingers 52 and the debrider cleaner fingers/gratings 74 at all angles while the lid 66 is opened.

While the debrider cleaner fingers/gratings 74 have been illustrated as being closed (e.g., gratings), it should be appreciated that the debrider cleaner fingers/gratings 74 may be open (e.g., fingers) similar to a comb. Additionally, it should be appreciated that while the agitator 18, debrider 50, and debrider cleaner 72 have been described in combination with a robot cleaning apparatus 10, the agitator 18, debrider 50, and/or debrider cleaner 72 are not limited to a robot cleaning apparatus 10 unless specifically claimed as such. In particular, the agitator 18, debrider 50, and/or debrider cleaner 72 may be integrated into any surface cleaning apparatus or surface cleaning head such as, but not limited to, upright vacuums, canister vacuums, handheld vacuums, and the like.

Figure 18:
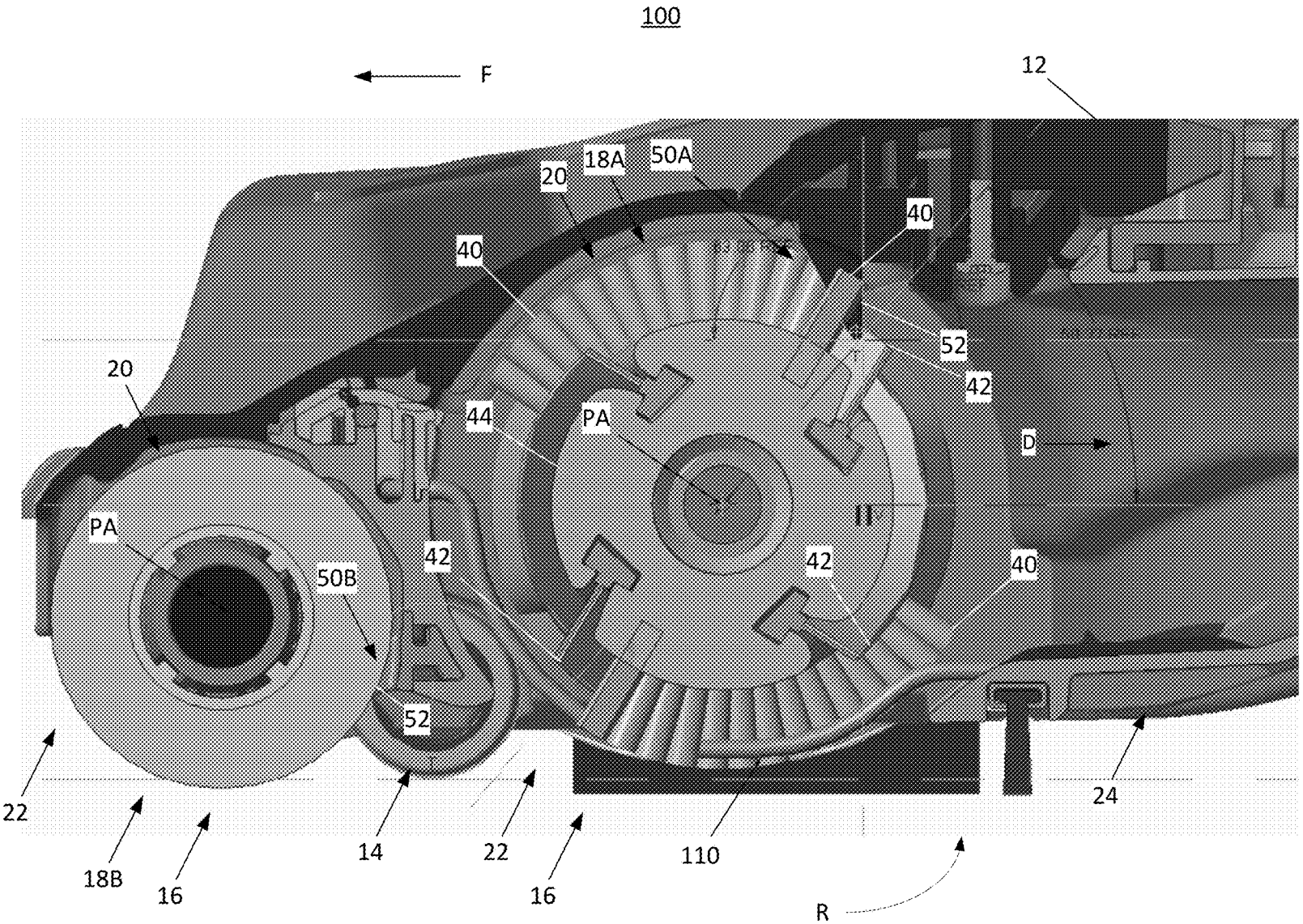
FIG. 18 is a perspective view of another embodiment of a surface cleaning apparatus.

Turning now to FIG. 18, another embodiment of a surface cleaning apparatus is generally illustrated. The surface cleaning apparatus may include an upright vacuum 100. The upright vacuum 100 may include a body or housing 12, optionally one or more wheels and/or more drive devices 14 (such as, but not limited to, one or more wheels and/or tracks driven by one or more electric motors and/or gears), and one or more cleaning devices 16. While not shown for clarity, the upright vacuum 100 may also include one or more controllers, motors, sensors, and/or power sources (e.g., but not limited to, one or more batteries) disposed within and/or coupled to the body 12. As is well understood, the controllers, motors, sensors (and the like) may be configured to pick-up (e.g., sweep up) and collect debris (for example, optionally using suction airflow).

The cleaning device 16 may include one or more agitators 18 that are rotatably driven at least partially within one or more agitator chambers 20 disposed within/defined by the body 12. The agitator chambers 20 include one or more openings 22 defined within and/or by a portion of the bottom surface/plate 24 of the body 12. The agitator 18 is configured to be coupled to the body 12 (either permanently or removably coupled thereto) and is configured to be rotated about a pivot axis PA (e.g., in the direction and/or reverse direction of arrow R) within the agitator chambers 20 by one or more rotation systems 26 (not shown for clarity) as described herein. In the illustrated embodiment, the forward direction of travel of the upright vacuum 100 is generally illustrated by arrow F.

In the illustrated embodiment, the upright vacuum 100 includes a primary agitator 18A and an optional secondary agitator 18B. When rotated, the agitators 18A and/or 18B are configured to pickup and/or sweep debris into one or more debris collection chambers (e.g., dust bins, not shown for clarity), e.g., as generally illustrated by arrow D. The debris collection chambers may be either permanently or removably coupled to the body 12, and are configured to be in fluid communication with the agitator chamber 20 such that debris collected by the rotating agitator 18 may be stored. Optionally, the agitator chamber 20 and debris chamber are fluidly coupled to a vacuum source (e.g., a vacuum pump or the like, not shown for clarity) for generating a partial vacuum in the agitator chamber 20 and debris collection chamber and to suck up debris proximate to the agitator chamber 22 and/or agitators 18A and/or 18B. As may be appreciated, the rotation of the agitators 18A and/or 18B may aid in agitating/loosening debris from the cleaning surface. Optionally, one or more filters may be provided to remove any debris (e.g., dust particles or the like) entrained in the partial vacuum air flow. The debris chamber, vacuum source, and/or filters may be at least partially located in the body 12. Additionally, one or more tubes, ducts, or the like 36 may be provided to fluidly couple the debris chamber, vacuum source, and/or filters.

The upright vacuum 100 may include one or more debriders 50. For example, a primary debrider 50A may be configured to contact the primary agitator 18A and a secondary debrider 50B may optionally be configured to contact the secondary agitator 18B, e.g., as generally described herein. The debrider 50 may include a plurality of fingers or teeth 52 as generally described herein.

The primary agitator 18A may include an elongated agitator body 44 that is configured to extend along and rotate about a longitudinal/pivot axis PA. The primary agitator 18A (e.g., but not limited to, one or more of the ends of the agitator 18) is permanently or removably coupled to the body 12 and may be rotated about the pivot axis PA by the rotation system. The primary agitator 18A includes a plurality of bristles 40 and at least one sidewall and/or continuous sidewall 42. The primary agitator 18A may include a plurality of bristles 40 aligned in two rows or strips, and a four sidewalls 42. The bristles 40 may include a plurality of tufts of bristles 40 arranged in rows and/or one or more rows of continuous bristles 40. The bristles 40 may include a longitudinal axis that extends along a radius of the primary agitator 18A (e.g., the bristles 40 arranged collinearly with the radius of the primary agitator 18A such that the longitudinal axis of the bristles 40 passes through the pivot axis PA of the primary agitator 18A).

The bristles 40 may extend radially outward beyond the sidewall 42. For example, the bristles 40 may extend radially up to 5 mm beyond the sidewall 42, e.g., between 0.5 mm and 5 mm beyond the sidewall 42, between 1 mm and 5 mm beyond the sidewall 42, between 2 mm and 4 mm beyond the sidewall 42, and/or 3.5 mm beyond the sidewall 42. If the upright vacuum 100 includes a cord guard 110, then the bristles 40 should extend below the cord guard 110 and the sidewall 42 should not contact the cord guard 110. Alternatively, if the upright vacuum 100 does not include a cord guard 110, then the bristles 40 and the sidewall 42 could be the same length. According to another embodiment, the sidewall 42 may extend beyond the distal most end of the bristles 40.

The primary agitator 18A may include a sidewall and/or continuous sidewall 42 adjacent to each of the rows of bristles 40. The bristles 40 preferably lead before the sidewall 42 when the primary agitator 18A is rotating in the direction of arrow R. The distal end of the sidewall 42 (i.e., the end of the sidewall 42 furthest from the center of rotation PA) may be 0-10 mm from the adjacent row 46 of bristles 40, such as 1-9 mm from the row 46 of bristles 40, 2-7 mm from the row 46 of bristles 40, and/or 1-5 mm from the row 46 of bristles 40, including all ranges and values therein.

It should be appreciated that while the primary agitator 18A is shown with two rows of bristles 40, two adjacent sidewalls 42, and two additional sidewalls 42, wherein the sidewalls 42 are set apart 90 degrees from one another about the pivot axis PA, the agitator 18 is not limited to this configuration unless specifically claimed as such. For example, the agitator 18 may include more or less than two rows of bristles 40 and/or may include more or less than four adjacent sidewalls 42. In particular, one or more rows of bristles 40 may not have an adjacent sidewall 42 and/or one or more rows of bristles 40 may include one or more adjacent sidewalls 42.

As described herein, the teeth 52 of the debrider 50 may be configured to contact the sidewall 42 as the agitator 18 is rotated about the pivot axis PA. For example, the distal most end of the teeth 52 may contact up to 10 mm of the distal most end of the sidewall 42, e.g., up to 6 mm of the distal most end of the sidewall 42, up to 5 mm of the distal most end of the sidewall 42, up to 3 mm of the distal most end of the sidewall 42, 1-6 mm of the distal most end of the sidewall 42, 1-5 mm of the distal most end of the sidewall 42, 1-3 mm of the distal most end of the sidewall 42, 0.5-3 mm of the distal most end of the sidewall 42, up to 2 mm of the distal most end of the sidewall 42, and/or 2 mm of the sidewall 42, including all ranges and values therein.

In an embodiment having three or more sidewalls 42 (e.g., but not limited to, an embodiment having four sidewalls 42), only two of the sidewalls 42 may contact the debrider 50 as the agitator is rotated about the pivot axis PA. If more than two sidewalls 42 contact the debrider 50 during rotation of the agitator 18, excessive noise may be created and/or the reliability of the sidewalls 42, teeth 52 of the debrider 50, and/or rotation systems 26 may be reduced.

It should be appreciated, however, that an agitator 18 may have three or more sidewalls 42 that contact the debrider 50 during rotation of the agitator 18. Increasing the number of more sidewalls 42 that contact the debrider 50 during rotation of the agitator 18 may increase noise and may increase the wear rate of the teeth 52 of the debrider 50; however, the performance of the agitator 18 may increase as the number of sidewalls 42 that contacts the debrider 50 increases. Having more than two sidewalls 42 contacting the debrider 50 may be particularly useful in applications having lower agitator 18 rotation rates and/or smaller nozzles.

Figure 19:
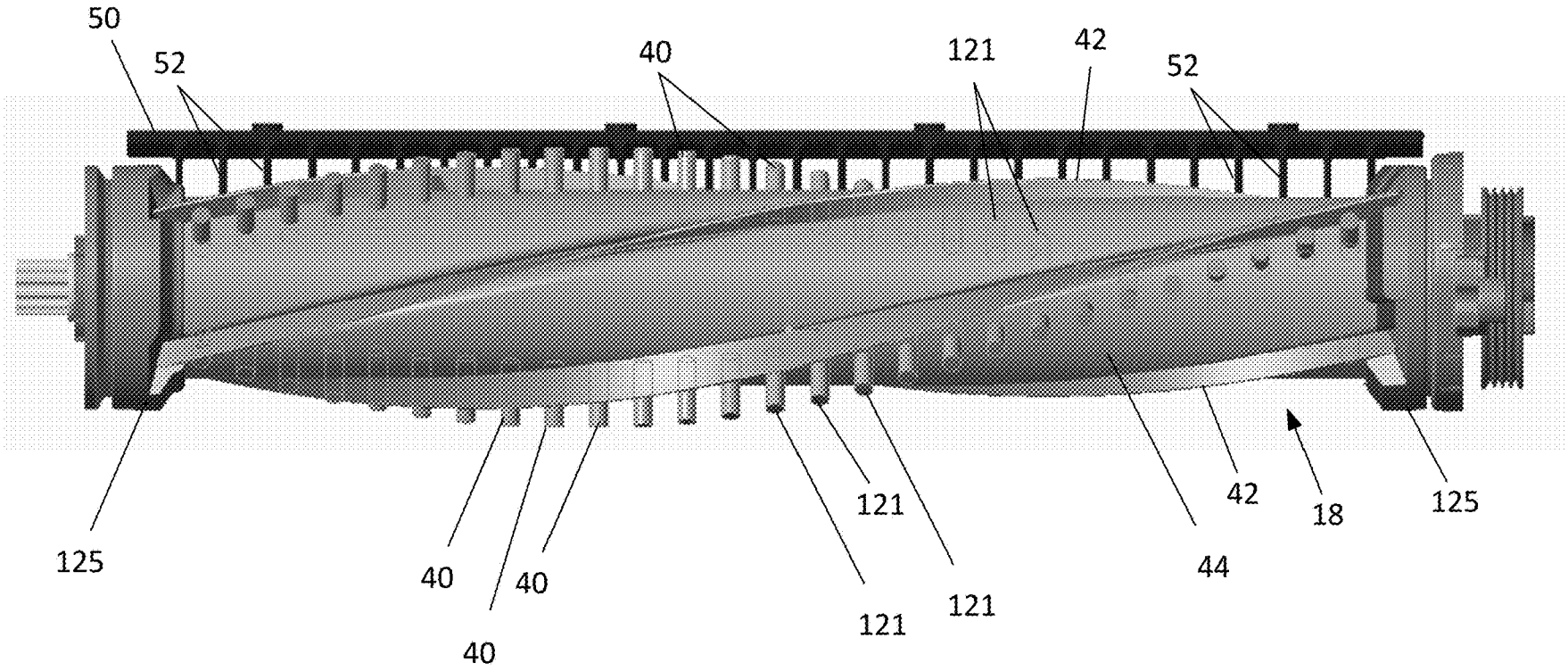
FIG. 19 is a perspective view of another embodiment of an agitator and a debrider.

According to one embodiment, the bristles 40 do not contact the teeth 52 of the debrider 50. For example, the bristles 40 may be grouped together to form tufts 121 of bristles as generally illustrated in FIG. 19. The tufts 121 of bristles 40 may be arranged in one or more rows (e.g., but not limited to linear and/or non-linear rows such as a helical and/or chevron pattern or the like). The teeth 52 of the debrider 50 may be spaced apart from each other such that the tufts 121 of bristles 40 do not contact the teeth 52 as the agitator is rotated about the pivot axis PA. For example, the tufts 121 of bristles 40 may have a cross-section (e.g., but not limited to, a diameter) that is less than the spacing between adjacent teeth 52. The length, arrangement, and size (e.g., bundle width) of the tufts 121 of bristles 42, and the spacing between the teeth 52, are therefore selected such that the tufts 121 of bristles 40 travel in the spaces between the teeth 52 and do not contact the teeth 52. According to one embodiment, the density of the teeth 52 (e.g., number of teeth 52 per inch) may be in the range of 1-16 teeth 52 per inch such as, but not limited to, 2-16 teeth 52 per inch, for example, 4 to 16 teeth 52 per inch and/or 7-9 teeth 52 per inch, including all ranges and values therein. For example, the teeth 52 may have a 2-5 mm center to center spacing, a 3-4 mm center to center spacing, a 3.25 mm center to center spacing, a 1-26 mm center to center spacing, a 2-26 mm center to center spacing, and/or a 1.58-25.4 mm center to center spacing, including all ranges and values therein. According to one embodiment, the bristles 40 (e.g., but not limited to, the tufts 121 of bristles 40) on opposite sides of the agitator 18 may be arranged in the same circumferential cross-section (i.e., not staggered) such that the bristles 40 do not contact the teeth 52 as the agitator 18 rotates about the pivot axis PA.

Referring back to FIG. 18, the debrider 50A may be located higher up (e.g., further away) from the surface to be cleaned compared to the debrider 50B which contacts the secondary agitator 18B (e.g., a soft roller). The debrider 50A may be located above the suction inlet 39 such that the suction helps to prevent debris from building up on the teeth 50 of the debrider 50A.

Turning now to FIGS. 20-23, another embodiment of the debrider 50 is generally illustrated. In particular, the teeth 52 of the debrider 50 in one or more of the lateral regions 115 may be configured to contact a smaller portion of the sidewall 42 compared to the teeth 52 in the central region 116. The lateral regions 115 of the debrider 50 may be defined as a region extending from one or more of the ends 117, 118 towards the other end of the debrider 50. The overall length of each lateral region 115 may include approximately up to 25% of the overall length Ld of the debrider 50, e.g., approximately 1-25% of the overall length Ld of the debrider 50, approximately 5-25% of the overall length Ld of the debrider 50, approximately 10-20% of the overall length Ld of the debrider 50, and/or approximately 10-25% of the overall length Ld of the debrider 50, including all values and ranges therebetween. The central region 116 may be defined as the remaining region of the debrider 50.

At least some of the teeth 52 in one or more of the lateral regions 115 may contact (e.g., overlap) a portion of the distal most end of the sidewall 42 in a range of 0% to less than 100% compared to the portion of at least some of the teeth 52 in the central region 116 that contact the distal most end of the sidewall 42. For example, some of the teeth 52 in a lateral region 115 may not contact the sidewall 42 and some of the teeth 52 in the lateral region 115 may contact less of the sidewall 42 compared to the largest overlapping portion of at least some of the teeth 52 in the central region 116 that contact the distal most end of the sidewall 42. In at least one embodiment, one or more of the teeth 52 in one or more of the lateral regions 115 may contact (e.g., overlap) a portion of the distal most end of the sidewall 42 in a range of 0% to less than 90% compared to the portion of at least some of the teeth 52 in the central region 116 that contact the distal most end of the sidewall 42, in a range of 0% to less than 80% compared to the portion of at least some of the teeth 52 in the central region 116 that contact the distal most end of the sidewall 42, in a range of 5% to less than 90% compared to the portion of at least some of the teeth 52 in the central region 116 that contact the distal most end of the sidewall 42, in a range of 0% to less than 75% compared to the portion of at least some of the teeth 52 in the central region 116 that contact the distal most end of the sidewall 42, and/or in a range of 5% to less than 75% compared to the portion of at least some of the teeth 52 in the central region 116 that contact the distal most end of the sidewall 42, including all values and ranges therebetween. For example, the distal most ends of the teeth 52 in the central region 116 may contact 2 mm of the distal most end of the sidewall 42 whereas the teeth 52 in at least one of the lateral regions 115 may not contact the sidewall while other teeth 52 in the same lateral region may contact less than 2 mm of the distal most end of the sidewall 42. Of course, this is merely an example, and the distal most ends of the teeth 52 in the central region 116 may contact more or less than 2 mm of the distal most end of the sidewall 42.

As such, the teeth 52 of the debrider 50 may be considered to taper from the central region 116 towards one or more of the lateral regions 115. The tapering of the teeth 52 in one or more of the lateral regions 115 compared to the central region 116 may prevent and/or reduce snapping of the trailing edge of the sidewall 42 as the sidewall 42 traverses (e.g., moves past) the teeth 52 of the debrider 50.

According to one embodiment, the length Lt of the teeth 52 of the debrider 50 in one or more of the lateral regions 115 may be smaller than length Lt of the teeth 52 in the central region 116. At least some of the teeth 52 of the debrider 50 in a lateral region 115 may have a length Lt that is in a range of 0% to less than 100% of the length Lt of the longest teeth 52 in the central region 116, in a range of 0% to less than 90% of the length Lt of the longest teeth 52 in the central region 116, in a range of 0% to less than 80% of the length Lt of the longest teeth 52 in the central region 116, in a range of 5% to less than 90% of the length Lt of the longest teeth 52 in the central region 116, in a range of 0% to less than 75% of the length Lt of the longest teeth 52 in the central region 116, and/or in a range of 5% to less than 75% of the length Lt of the longest teeth 52 in the central region 116, including all values and ranges therebetween. It should be appreciated that the teeth 52 in the central region 116 may have different dimensions (e.g., lengths) which overlap different portions (e.g., amounts) of the sidewall 42.

Figure 20:
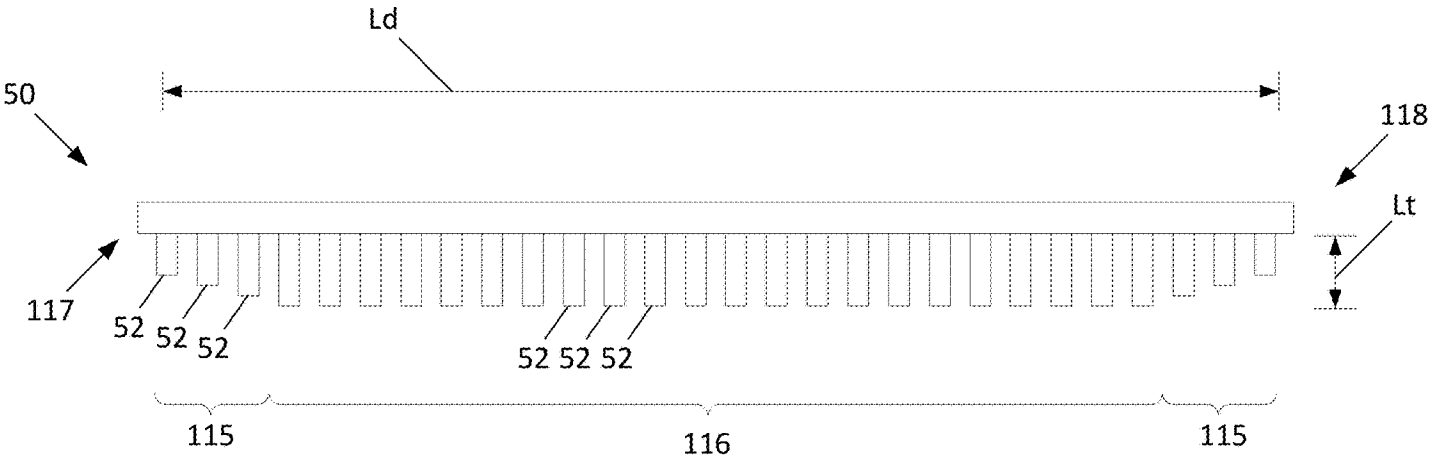
FIG. 20 is a perspective view of one embodiment of a debrider having a tapered tooth profile.
Figure 21:
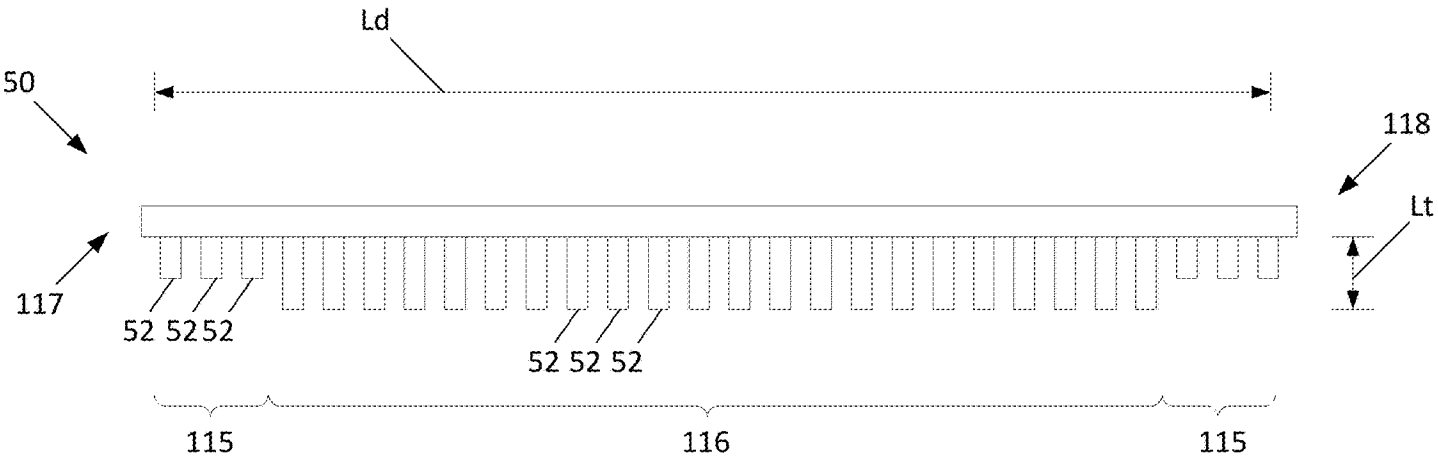
FIG. 21 is a perspective view of a further embodiment of a debrider having a tapered tooth profile.

With reference to FIG. 20, the portion of the distal most end of the sidewall 42 that the teeth 52 in one or more of the lateral regions 115 contact (e.g., overlap) may gradually reduce from the central region 116 towards the ends 117, 118. The reduction in the overlap of the teeth 52 in the lateral region 115 may be generally linear and/or generally non-linear. Alternatively (or in addition), the portion of the distal most end of the sidewall 42 that the teeth 52 in one or more of the lateral regions 115 contact (e.g., overlap) may step down when transitioning from the central region 116 to the lateral regions 115 as generally illustrated in FIG. 21. The portion of the distal most end of the sidewall 42 that that the teeth 52 in one or more of the lateral regions 115 contact may be substantially constant in the lateral region 115 and/or may vary.

Figure 22:
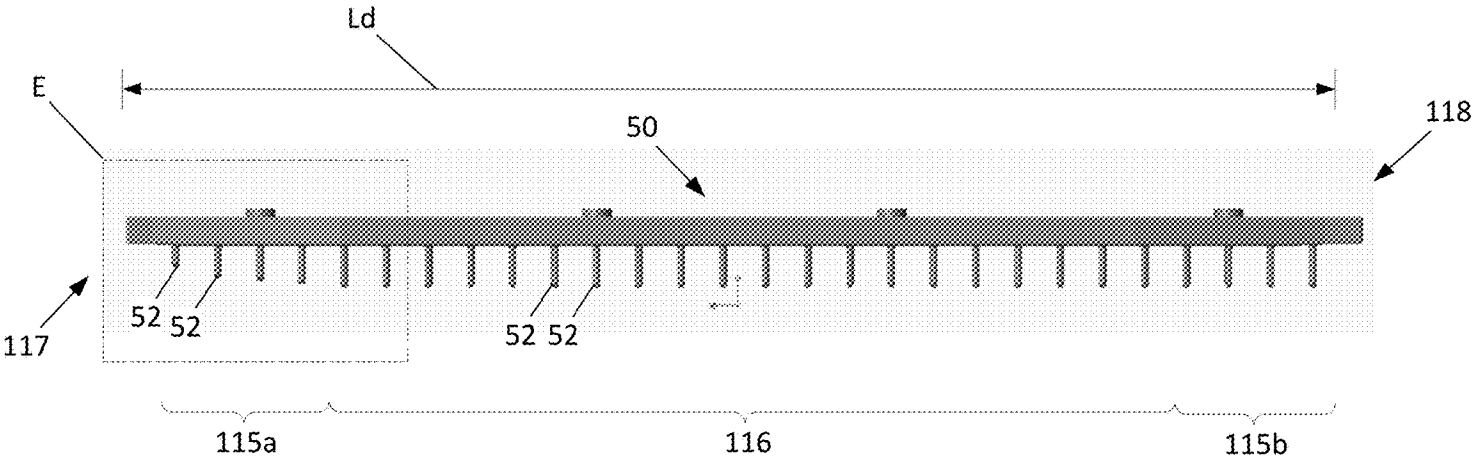
FIG. 22 is a perspective view of another embodiment of a debrider having a tapered tooth profile.
Figure 23:
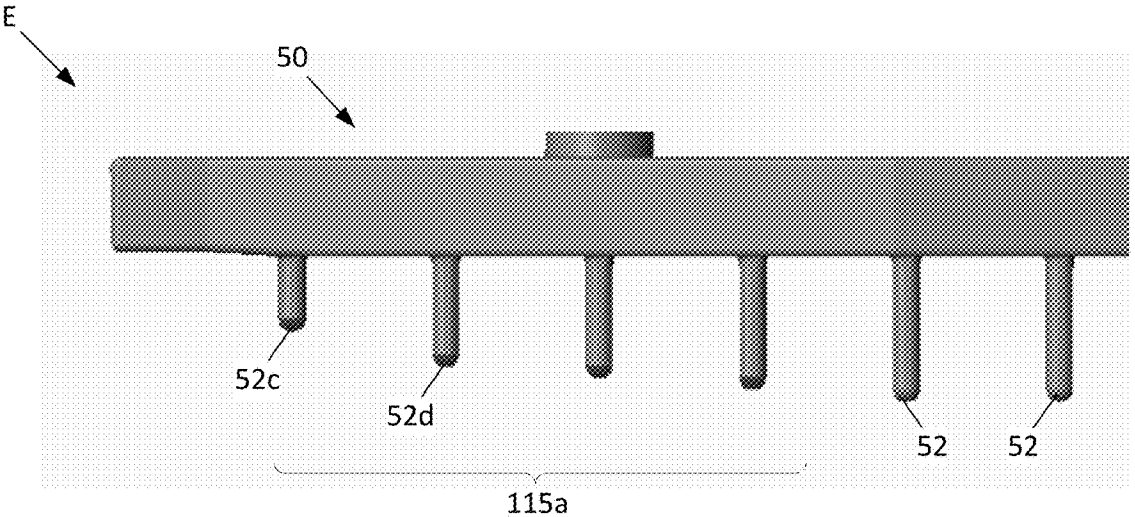
FIG. 23 is a close up of region E in FIG. 22.

Referring now to FIGS. 22-23, the debrider 50 may include only a single lateral region 115*a* with one or more teeth 52 that contact (e.g., overlap) a portion of the distal most end of the sidewall 42 in the range of 0% to less than 100% compared to the portion of at least some of the teeth 52 in the central region 116 that contact the distal most end of the sidewall 42. In particular, the location of the tapered lateral region 115*a* (i.e., end 117 or end 118 of the debrider 50) is selected based on which end 117, 118 of the debrider 50 is the last end to contact the sidewall 42 as the agitator 18 rotates in its normal direction (i.e., the direction of rotation of the agitator 18 during cleaning). The tapered lateral region 115*a* may therefore be considered to be the trailing edge of the debrider 50, e.g., the last edge or end of the debrider 50 to be in contact with the sidewall 42 as the agitator 18 rotates about the pivot axis PA. As such, the tapered lateral region 115*a* may be selected based on the direction of the rotation of the agitator 18 and/or the direction of the twist of the sidewall 42. As noted herein, one or more of the teeth 52 in the lateral region 115*a* (e.g., tooth 52*c*) may not contact the sidewall 42 while one or more of the teeth in the lateral region 115*a* (e.g., tooth 52*d*) may contact a portion of the sidewall 42 that is less than the largest portion that a tooth 52 in the central region 116 contacts the sidewall 42 as the agitator 18 rotates about the pivot axis PA.

Figure 24:
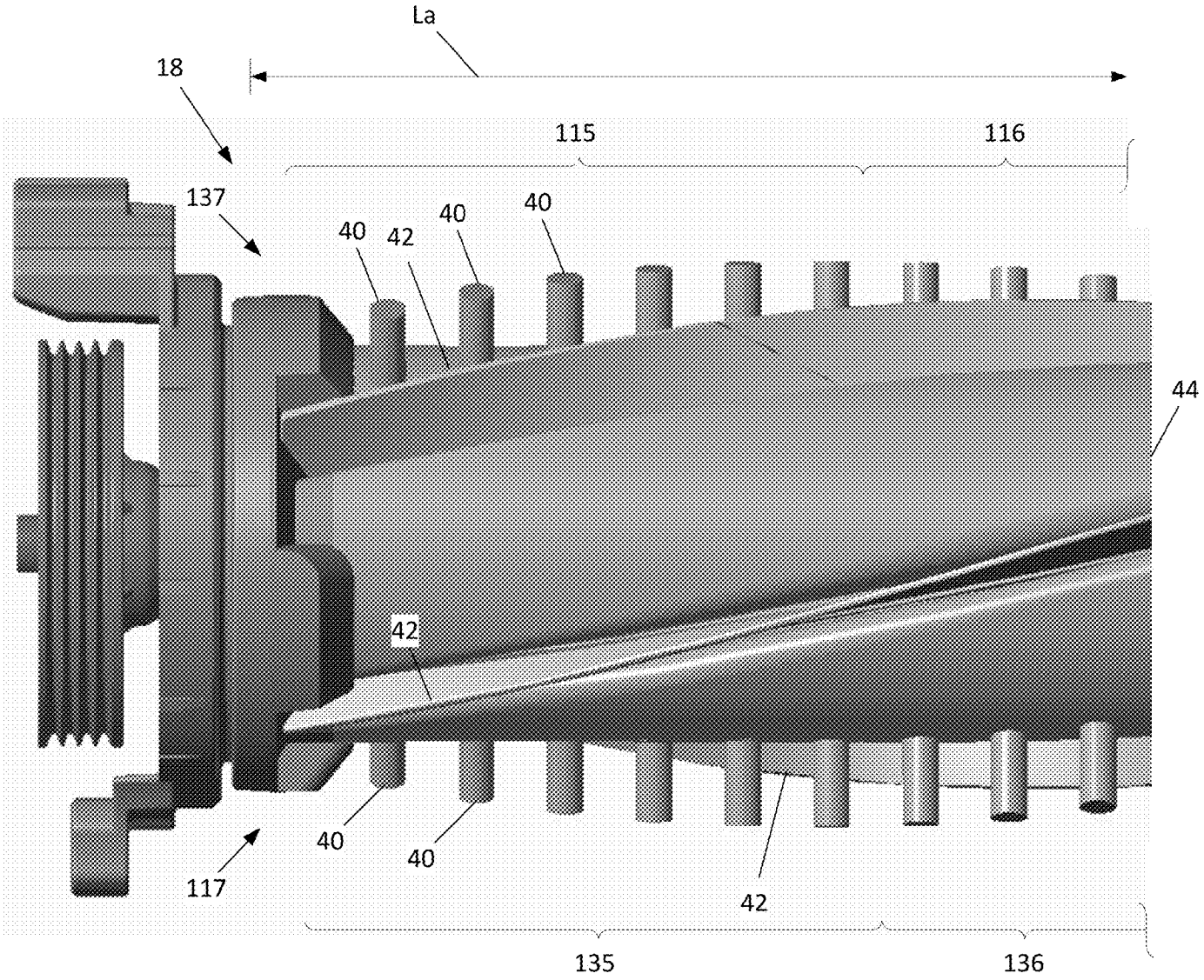
FIG. 24 is a perspective view of an end of another embodiment of an agitator having a sidewall with an increased thickness.

Turning now to FIG. 24, another embodiment of an agitator 18 is generally illustrated. The agitator 18 may include one or more lateral regions 135 in which one or more sidewalls 42 have an increased thickness compared to the thickness of the same sidewall 42 in the central region 136. The lateral regions 125 of the agitator 18 may be defined as a region of the agitator 18 extending from one or more of the ends 137 of the agitator 18 (only a single end shown) towards the other end of the agitator 18. The overall length of each lateral region 135 may include approximately up to 25% of the overall length La of the agitator 18, e.g., approximately 1-25% of the overall length La of the agitator 18, approximately 5-25% of the overall length La of the agitator 18, approximately 10-20% of the overall length La of the agitator 18, and/or approximately 10-25% of the overall length La of the agitator 18, including all values and ranges therebetween. The central region 136 of the agitator 18 may be defined as the remaining region of the agitator 18. According to one embodiment, the lateral region 135 of the agitator 18 may correspond to (e.g., be the same as) the lateral region 115 of the debrider 50.

In the illustrated embodiment, the agitator 18 may include only a single lateral region 135 having a sidewall 42 with an increased thickness. In particular, the location of the lateral region 135 is selected based on which end of the agitator 18 is the last end to contact the teeth 52 of the debrider 50 as the agitator 18 rotates in its normal direction (i.e., the direction of rotation of the agitator 18 during cleaning). The lateral region 135 may therefore be considered to be the trailing edge of the agitator 18, e.g., the last edge or end of the sidewall 42 to be in contact with the teeth 52 of the debrider 50 as the agitator 18 rotates about the pivot axis PA. As such, the lateral region 135 may be selected based on the direction of the rotation of the agitator 18 and/or the direction of the twist of the sidewall 42.

At least a portion of the sidewall 42 in one or more of the lateral regions 135 may have a stiffness which is greater than the maximum stiffness of the same sidewall 42 in the central region 136. The increased stiffness of the sidewall 42 in the lateral region 135 is configured to produce an even amount of deflection of the sidewall 42 along the full length of the sidewall 42 as the agitator 18 rotates about the pivot axis PA (i.e., the sidewall 42 deflects backwards when contacted by the teeth 52 of the debrider 50). Without the increased stiffness of the sidewall 42 in the lateral region 135, the teeth 52 of the debrider 50 will deflect the sidewall 42, at the trailing edge of the sidewall 42, up to approximately three times as much as elsewhere on the sidewall 42, which may cause the sidewall 42 to wear at an accelerated rate in that area. Therefore, the sidewall 42 may be strengthened in the lateral region 135 to achieve the appropriate balance of sidewall 42 geometry (locally increasing the stiffness of the sidewall 42) and even deflection across the length of the sidewall 42 (to maintain hair removal function). For example, at least a portion of the sidewall 42 in the lateral region 135 may have a stiffness up to 300% thicker than the largest stiffness of the same sidewall 42 in the central region 136 of the agitator 18, a stiffness up to 200% stiffer than the largest stiffness of the same sidewall 42 in the central region 136 of the agitator 18, between 100% and up to 300% stiffer than the largest stiffness of the same sidewall 42 in the central region 136 of the agitator 18, between 200% and up to 300% stiffer than the largest stiffness of the same sidewall 42 in the central region 136 of the agitator 18, and/or between 100% and up to 200% stiffer than the largest stiffness of the same sidewall 42 in the central region 136 of the agitator 18, including all values and ranges therebetween.

For example, at least a portion of the sidewall 42 in one or more of the lateral regions 135 may have a thickness which is larger than the maximum thickness of the same sidewall 42 in the central region 136. The increased thickness of the sidewall 42 in the lateral region 135 is configured to produce an even amount of deflection of the sidewall 42 along the full length of the sidewall 42 as the agitator 18 rotates about the pivot axis PA (i.e., the sidewall 42 deflects backwards when contacted by the teeth 52 of the debrider 50). Without the increased thickness of the sidewall 42 in the lateral region 135, the teeth 52 of the debrider 50 will deflect the sidewall 42, at the trailing edge of the sidewall 42, up to approximately three times as much as elsewhere on the sidewall 42, which may cause the sidewall 42 to wear at an accelerated rate in that area. Therefore, the sidewall 42 may be strengthened in the lateral region 135 to achieve the appropriate balance of sidewall 42 geometry (locally increasing the stiffness of the sidewall 42) and even deflection across the length of the sidewall 42 (to maintain hair removal function). For example, at least a portion of the sidewall 42 in the lateral region 135 may have a thickness up to 300% thicker than the largest thickness of the same sidewall 42 in the central region 136 of the agitator 18, a thickness up to 200% thicker than the largest thickness of the same sidewall 42 in the central region 136 of the agitator 18, between 100% thick and up to 300% thicker than the largest thickness of the same sidewall 42 in the central region 136 of the agitator 18, between 200% thick and up to 300% thicker than the largest thickness of the same sidewall 42 in the central region 136 of the agitator 18, and/or between 100% thick and up to 200% thicker than the largest thickness of the same sidewall 42 in the central region 136 of the agitator 18, including all values and ranges therebetween.

Referring back to FIG. 19, one or more of the agitators 18 (e.g., but not limited to, the primary agitator 18A) may include one or more enlarged end caps 125. The sidewalls 42 may extend across the elongated body 44 of the agitator 18 and may generally abut against and/or extend into a recess formed in the enlarged end caps 125. The recess may create overlap between the end of the sidewall 42 strip and the end cap 125 such that hair cannot wrap around the sidewalls 42. The enlarged end caps 125 may extending radially beyond the distal most portion of the sidewall 42. For example, the diameter of the enlarged end caps 125 may be larger (e.g., extends radially further) than the sidewall 42. This configuration may prevent debris (e.g., hair or the like) from migrating laterally from the sidewall 42 beyond the end cap 125. Put another way, the enlarged end caps 125 may prevent hair from wrapping around the agitator 18 at the ends of the agitator 18.

While the surface cleaning apparatus of FIGS. 18-24 is shown as an upright vacuum 100, it should be appreciated that the agitator 18 and/or debrider 50 may be integrated into any surface cleaning apparatus or surface cleaning head such as, but not limited to, robot cleaning apparatus, canister vacuums, handheld vacuums, and the like.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus and/or agitator may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. An agitator assembly comprising:

an agitator configured to rotate about a pivot axis, the agitator comprising:

an elongated body having a first and a second end; and a flap extending from the first end towards the second end, having a flap height extending outward from the elongated body and a flap width perpendicular to the pivot axis; and a first end cap disposed at the first end of the elongated body, the first end cap including a recess having first and second sidewalls defining an opening therebetween, with a portion of the flap positioned within the recess, the recess having a recess width perpendicular to the pivot axis, the recess width being smaller than the diameter of the elongated body and greater than the flap width along the entire radial height of the recess, such that at least one of the first and second sidewalls of the recess is spaced from the flap.

2. The agitator assembly of claim 1, wherein the flap abuts against the first end cap.

3. The agitator assembly of claim 1, wherein the flap extends into and abuts against a portion of the first end cap defining the recess.

4. The agitator assembly of claim 3, wherein the recess creates an overlap between a first end of the first end cap and the first end cap.

5. The agitator assembly of claim 1, wherein the agitator further comprises a plurality of bristles extending outward from the elongated body.

6. The agitator assembly of claim 5, wherein the plurality of bristles are arranged in at least one row adjacent to the flap.

7. The agitator assembly of claim 5, wherein the plurality of bristles are disposed in front of the flap as the agitator rotates in a first direction about the pivot axis such that the plurality of bristles lead the flap.

8. The agitator assembly of claim 5, wherein the plurality of bristles are arranged substantially parallel to the flap.

9. The agitator assembly of claim 5, wherein the plurality of bristles are arranged immediately adjacent to the flap.

10. The agitator assembly of claim 1, further comprising a second end cap disposed at the second end of the elongated body.

11. The agitator assembly of claim 10, wherein the second end cap including a second recess having third and fourth defining a second opening configured to receive another portion of the flap, the second recess having a second recess width perpendicular to the pivot axis, the second recess width being greater than the flap width, wherein at least one of the third and fourth sidewalls of the second recess is spaced from the flap.

12. The agitator assembly of claim 1, wherein the first end cap is fixed relative to the agitator.

13. The agitator assembly of claim 5, wherein at least a portion of the plurality of bristles have a height that is longer than a height of the flap.

14. The agitator assembly of claim 5, wherein at least a portion of the plurality of bristles have a height that is 2-3 mm longer than a height of the flap.

15. The agitator assembly of claim 5, wherein a height of the flap is 60 to 100% of a height of at least a portion of the plurality of bristles.

16. The agitator assembly of claim 5, wherein the plurality of bristles have a height that extends at least 2 mm beyond a distal-most end of the flap.

17. The agitator assembly of claim 5, wherein the flap has a height of at least 2 mm and is 50% or less of a height of the plurality of bristles.

18. The agitator assembly of claim 1, wherein the flap includes a flexible and/or elastomeric material.

19. The agitator assembly of claim 18, wherein the flap includes rubber or silicone.

20. The agitator assembly of claim 1, wherein the flap includes combination of a flexible and/or elastomeric material and fabric.

21. The agitator assembly of claim 20, wherein the fabric includes a polyester fabric.

22. The agitator assembly of claim 20, wherein the flap includes a combination of a polyurethane and a fabric.

23. The agitator assembly of claim 22, wherein the fabric includes a polyester fabric.

24. The agitator assembly of claim 5, wherein the plurality of bristles include a plurality of tufts of bristles.

25. The agitator assembly of claim 5, wherein the plurality of bristles include a row of bristles.

26. The agitator assembly of claim 5, wherein the plurality of bristles include a substantially continuous row of bristles.

27. An agitator assembly comprising:

an agitator configured to rotate about a pivot axis, the agitator comprising:

an elongated body having a first and a second end; and a flap extending from the first end towards the second end, having a flap height extending outward from the elongated body and a flap width perpendicular to the pivot axis;

a first end cap disposed at the first end of the elongated body, the first end cap including a recess having first and second sidewalls defining an opening with a portion of the flap positioned therein, the recess having a recess width perpendicular to the pivot axis, the recess width being greater than the flap width along the entire radial height of the recess, such that at least one of the first and second sidewalls of the recess is spaced from the flap, and a second end cap disposed at the second end of the elongated body.

28. The agitator assembly of claim 27, wherein the agitator further comprises a plurality of bristles extending outward from the elongated body.

29. The agitator assembly of claim 28, wherein at least a portion of the plurality of bristles have a height that is longer than a height of the flap.

30. The agitator assembly of claim 27, wherein the flap includes a flexible and/or elastomeric material.

31. The agitator assembly of claim 30, wherein the flap includes rubber or silicone.

32. The agitator assembly of claim 27, wherein the flap includes combination of a flexible and/or elastomeric material and fabric.

33. The agitator assembly of claim 32, wherein the fabric includes a polyester fabric.

34. The agitator assembly of claim 32, wherein the flap includes a combination of a polyurethane and a fabric.

35. The agitator assembly of claim 34, wherein the fabric includes a polyester fabric.

* * * * *